United States Patent [19]

Deutsch

[11] 4,112,803

[45] Sep. 12, 1978

[54] ENSEMBLE AND ANHARMONIC GENERATION IN A POLYPHONIC TONE SYNTHESIZER

[75] Inventor: Ralph Deutsch, Sherman Oaks, Calif.

[73] Assignee: Deutsch Research Laboratories, Ltd., Los Angeles, Calif.

[21] Appl. No.: 644,450

[22] Filed: Dec. 29, 1975

[51] Int. Cl.[2] ..... G10H 1/02; G10H 5/00

[52] U.S. Cl. ..... 84/1.24; 84/DIG. 4; 364/419; 364/718

[58] Field of Search ..... 84/1.01, 1.03, 1.24, 84/DIG. 4; 235/152, 197; 364/419, 718

[56] References Cited

U.S. PATENT DOCUMENTS

| | | | |
|---|---|---|---|
| 3,809,786 | 5/1974 | Deutsch | 84/1.01 |
| 3,809,792 | 5/1974 | Deutsch | 84/1.24 |
| 3,884,108 | 5/1975 | Deutsch | 84/1.24 |
| 3,888,153 | 6/1975 | Deutsch | 84/1.01 |

*Primary Examiner*—Stanley J. Witkowski
*Attorney, Agent, or Firm*—Ralph Deutsch

[57] ABSTRACT

A musical ensemble effect results when two tones slightly out-of-tune with respect to each other are sounded together upon selection of a single instrument key. Herein, apparatus is disclosed for producing an ensemble effect in a polyphonic tone synthesizer of the type wherein musical notes are produced polyphonically by computing a master data set, transferring data set to buffer memories, and repetitively converting in real time contents of memories to notes. A multiplicity of master data sets are created repetitively and independently of tone generation by computing a generalized Fourier algorithm using stored sets of generalized Fourier coefficients. The phase of such master data sets are generated with time varying phase shifts to provide theout-of-tune ensemble effects. The phase shifted master data sets are combined and transferred to buffer memories from which such data is converted to musical sounds. Means are included for inhibiting phase shifts of fundamental frequency components and thereby creating musical tones having anharmonic overtones.

22 Claims, 11 Drawing Figures

ENSEMBLE AND ANHARMONIC GENERATION IN A POLYPHONIC TONE SYNTHESIZER

BACKGROUND OF THE INVENTION

1. Field of the Invention

The present invention relates to production of ensemble and anharmonic overtones in a polyphonic tone synthesizer.

2. Description of the Prior Art

An ensemble effect is produced in a pipe organ by using two or more ranks of pipes, one of which is tuned to the nominally correct eight-foot frequency while another is slightly out-of-tune. When a single keyboard switch is depressed, both the in-tune and out-of-tune pipes are sounded. The resultant beat frequencies are most pleasant to the listener. An ensemble effect using two sets of pipes having the same or essentially similar tonal quality is known as "doubling." More complex effects are achieved using three or more sets of pipes and thereby more closely approaching the ensemble effect of a full orchestra.

In conventional electronic organs an ensemble effect is obtained by using separate sets of oscillators offset in frequency with respect to the nominal in-tune tone generators. When combined electronically or acoustically, the combined generator outputs produce an ensemble effect. Alternatively, two separate and complete electronic organ systems, detuned with respect to each other and used to drive different speakers, may be used to produce ensemble. Such approaches are expensive and virtually rule out ensemble effects more complex than two out-of-tune systems. Deutsch, in U.S. Pat. No. 3,884,108 discloses a system for producing ensemble in a Computer Organ such as that described by Deutsch in U.S. Pat. No. 3,809,786. Therein is disclosed apparatus for producing an ensemble effect in a computor organ of the type wherein muscial notes are generated by computing the amplitudes at successive sample points of a musical waveshape and converting the amplitudes to sounds as the computations are carried out in real time. Each amplitude is computed during a regular time interval $t_x$ by separately calculating a set of "combined" Fourier components which are accumulated to obtain the sample point amplitude. Each $n^{th}$ order combined Fourier component is evaluated by summing a pair of sinusoid values associated respectively with the nominal tone and the frequency offset, "out-of-tune" tone. The sum is multiplied by a harmonic coefficient to establish the relative amplitude of that combined Fourier component.

Deutsch, in U.S. Pat. No. 3,888,153 discloses a system for producing tones having anharmonic overtones in a Computer Organ (U.S. Pat. No. 3,809,786). Therein is disclosed apparatus for creating, in real time, tones wherein the fundamental frequency is at the true nominal pitch but the overtones are displaced from their true frequencies. This frequency displacement is such that if an amount $d$ is used for the second harmonic, then $2d$ is used for the third harmonic; and $(n-1)d$ is used for the $n^{th}$ harmonic. The means disclosed in U.s. Pat. No. 3,888,153 for producing anharmonic overtones in a Computor Organ are essentially similar to the means disclosed in U.S. Pat. No. 3,884,108 for producing ensemble effects in a Computor Organ. The principle difference being that for anharmonic tone generation the Fourier components corresponding to the fundamental frequency are computed for the true pitch while only the overtones are computed out-of-tune.

An object of the present invention is to provide a single system for producing ensemble effects in combination with anharmonic overtones in a polyphonic tone synthesizer. The subsystem add-on to a polyphonic tone synthesizer is inexpensive and provides tonal effects heretofore only available on large expensive electronic organs.

SUMMARY OF THE INVENTION

In a Polyphonic Tone Synthesizer of the type described in patent application Ser. No. 603,776, filed Aug. 11, 1975, now U.S. Pat. No. 4,085,644, commonly assigned and herein incorporated by reference a computation cycle and a data transfer cycle are repetitively and independently implemented to provide data which is converted to musical notes. During the computation cycle a master data set is created by implementing a discrete Fourier algorithm using a stored set of harmonic coefficients which characterize the basic musical tone. The computations are carried out at a fast rate which may be nonsynchronous with any musical frequency. Provision is made for time varying the amplitudes of the computational orthogonal functions so that the musical effect of sliding formant filters is generated. Preferably, the harmonic coefficients and the orthogonal functions are stored in digital form, and the computations are carried out digitally. At the end of the computation cycle a master data set has been created and is temporarily stored in a data register.

Following a computation cycle, a transfer cycle is initiated which transfers the master data set to a multiplicity of read-write memories. The transfer for each memory is initiated by detection of a synchronizing bit and is timed by a clock which is asynchronous with the main system clock and has a frequency of $Pf$, where $f$ is the frequency of a particular note assigned to a memory and P is two times the maximum number of harmonics in the musical waveshape. The transfer cycle is completed when all the memories have been loaded, at which time a new computation cycle is initiated. Tone generation continues uninterrupted during computation and transfer cycles. A time shared digital-to-analog convertor transforms the output data from the read-write memories to analog voltages assigned to individual tone channels. The digital-to-analog converter is time sequenced with each memory output data conversion to provide attack, decay, sustain, release, and other amplitude modulation effects.

The subject invention uses the well-known property that a waveshape having a phase constant that linearly increases (decreases) with time is equivalent to the same waveshape at a higher (lower) frequency. In accordance with the present invention a master data set is created during a computation cycle according to the relationship $$G(N) = Z(N) + X(N) \qquad \text{(Equation 1)}$$

and $$Z(N) = \sum_{q=1}^{W} c_q \sin(\pi Nq/W) \qquad \text{(Equation 2)}$$

$$X(N) = \sum_{q=1}^{M} d_q \sin[\pi Nq(1+jk)/W] \qquad \text{(Equation 3)}$$

where N=1,2, . . . ,2W is the number of a master data set word; $q=1,2, \ldots ,W$ is the harmonic number.

$W=N/2$ is the number of harmonics used to synthesize the Z(N) components of the master data set which are the "in tune" components. M is the number of harmonics used to synthesize the X(N) components of the master data set which are the "out-of-tune" components. M is less than or equal to W. $k$ is a phase constant and $j$ is an integer that is incremented to cause the linear phase shift increase in the components X(N).

The minimum phase shift that can be created depends upon the resolution, or number of stored data points, in the sinusoid table used as a means to implement Equation 3. Advantageously a sinusoid table having 256 entries is used. This number provides sinusoid values at intervals of $360/256=1.40625$ degrees. For a polyphonic tone synthesizer operating at a 1 Mhz clock rate, and $M=8$ harmonics, then the $NM=64\times 8=512$ bit times required to compute the X(N) components of the master data set are accomplished in 0.512 milliseconds. In one second the number of complete sets of such calculations is $1/(0.512\ 10^{-3})=1953.125$. Therefore the total phase shift that can be generated in one second is $1953.125\times 1.40625=2746.58$ degrees per second; or 47.94 radians per second. A linear phase shift of this magnitude corresponds to a frequency shift of $\Delta f=47.94/2\pi=7.63$ hz. This $\Delta f$ corresponds to a frequency shift of 6.6 cents at all musical frequencies; a value that has been found to correspond to an acceptable musical ensemble effect.

Advantageously the phase shift constant $k$ is selected as $k=2^{-m}$, where $m$ is an integer. $j$ is selected as increasing integers modulo $1/(2k)$.

Anharmonic overtones are generated, for example, by inhibiting the ensemble phase shift of X(N) for the fundamental. That is, in place of Equation 3, the following relationship is implemented $$X(N) = d_1 \sin(\pi N/W) + \sum_{q=2}^{M} d_q \sin[\pi Nq(1+jk)/W]. \quad \text{(Equation 4)}$$

Means are described for simultaneously creating both ensemble and anharmonic overtones or a selection of either.

BRIEF DESCRIPTION OF THE DRAWINGS

A detailed description of the invention will be made with reference to the accompanying drawings, wherein like numerals designate like components in the several figures.

DESCRIPTION OF THE PREFERRED EMBODIMENT

The following detailed description is of the best presently contemplated modes of carrying out the invention. This description is not to be taken in a limiting sense, but is made merely for the purpose of illustrating general principles of the invention since the scope of the invention is best defined by the appended claims. Structural and operational characteristics attributed to forms of the invention first described shall also be attributed to forms later described, unless such characteristics are obviously inapplicable or unless specific exception is made.

Figure 1:
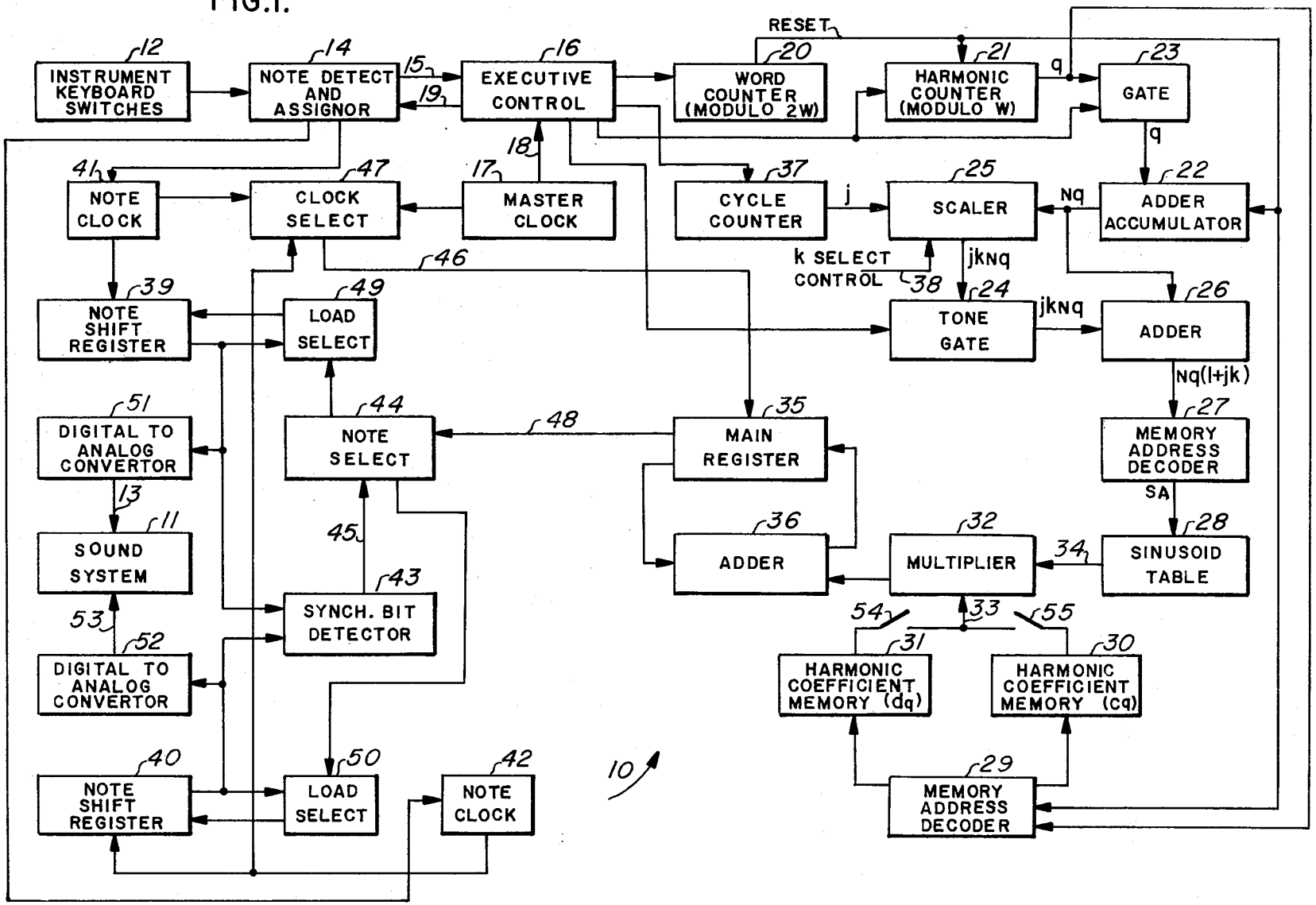
FIG. 1 is an electrical block diagram of a polyphonic tone synthesizer configured to produce ensemble effects.
Figure 2:
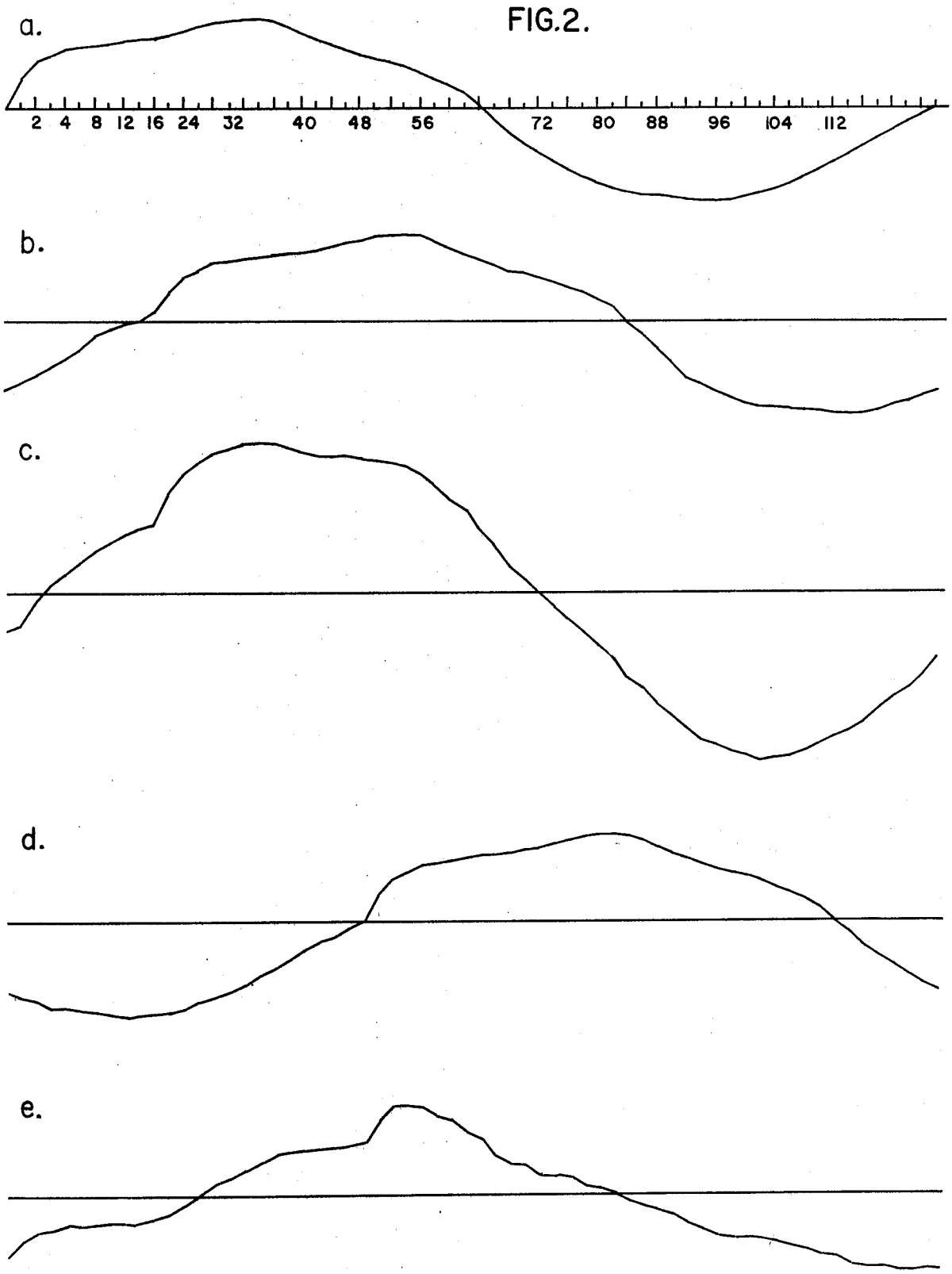
FIG. 2 shows typical master data sets created during computation cycle.

The polyphonic tone synthesizer 10 of FIG. 1 operates to produce via a sound system 11, musical notes having an ensemble quality which are selected by actuating switches associated with instrument keyboard switches 12 FIG. 1 is a modification to the Polyphonic Tone Synthesizer shown and described in U.S. Pat. No. 4,085,644 which is hereby incorporated by reference. FIG. 2 illustrates typical musical waveshapes supplied to sound system 11 via line 13 when the instrument keyboard switch associated with the musical note $C_7$ is actuated. FIG. 2*a* illustrates the musical waveshape a without ensemble. FIG. 2*b* illustrates a second waveshape *b* that is advanced in phase relative to the waveshape in FIG. 2*a*. FIG. 2*c* illustrates the sum of waveshapes *a* and *b*. FIG. 2*d* illustrates a curve *d* which is similar to *b* but is advanced further in phase. FIG. 2*e* shows the sum of curves *a* and *d*.

As described below, each such combination waveshape is generated by first computing a master data set (as described in U.S. Pat. No. 4,085,644) and then adding to the first master data set a second master data set which is advanced in phase with respect to the first master data set. The data set resulting from this addition is called the resultant master data set. The resultant master data set is then transformed to the time domain (data amplitudes become a function of time) and finally is stretched in time so that its fundamental period (i.e. first harmonic period) corresponds to the actuated switch on the instrument keyboard 12. The computation of the resultant master data set is performed repetitively and each time the phase of the second master data set is advanced in such a manner that the phase shift advances as a linear function of time. The second master data set is also called the phased master data set.

A musical signal, or musical waveshape, produced by a sound system 11 generally consists of an analog voltage having a waveshape (i.e. voltage as a function of time) which is a superposition or composite of the harmonic components of the corresponding sound. Such a complex waveshape may be described mathematically in terms of its harmonic components by the well-known Fourier series equations for a periodic waveshape. The circuitry of 10 in FIG. 1 operates by first synthesizing a first master data set computed by the following discrete Fourier series $$Z(N) = \sum_{q=1}^{W} c_q \sin(\pi Nq/W) \quad \text{(Equation 5)}$$

where $N=1,2,\ldots,2W$ is the number of a master data set word, $q=1,2,\ldots,W$ is the harmonic number, $W=N/2$ is the number of harmonics used to synthesize the master data set, and $c_q$ are the harmonic coefficients for tone No. 1. $q$ is sometimes called the order of the harmonic component.

The second master data set, or phased master data set, is computed by the following discrete Fourier series $$X(N) = \sum_{q=1}^{W} d_q \sin[\pi Nq(1+jk)/W] \quad \text{(Equation 6)}$$

where $j$ is a function of time that increases in value for each computation of the second master data set and $k$ is a predetermined constant. While the invention is illustrated for the combination of two tones or "stops", one fixed in frequency corresponding to the first master data set, and the second advanced in frequency corresponding to the second master data set, the extension to any plurality of tones should be apparent to those skilled in the art.

The second master data set may consist of a combination of R tones each of which is computed by the following discrete series $$X_1(N) = \sum_{q=1}^{M_1} d_{1q} \sin[\pi Nq(1+jk_1)/W] \quad \text{(Equation 7)}$$

$$X_2(N) = \sum_{q=1}^{M_2} d_{2q} \sin[\pi Nq(1+jk_2)/W] \quad \text{(Equation 8)}$$

$$X_p(N) = \sum_{q=1}^{M_p} d_{pq} \sin[\pi Nq(1+jk_p)/W] \quad \text{(Equation 9)}$$

where $p=1,2,\ldots,R$ is an index designating the out-of-tune submaster data sets which are advanced in frequency. $M_p$ is an integer not greater than W and specifies the number of harmonic components in the set of harmonic coefficients $d_{pq}$ assigned to each of the out-of-tune submaster data set. The numbers $d_{pq}$ are harmonic coefficients of the $q$th harmonic. They establish the relative amplitude of the corresponding $q$th components of the submaster data sets. The numbers $k_p$ are phase constants which determine the frequency detuning of each member $X_p(N)$ of the submaster data sets. The number $k_p$ may be selected from a predetermined set of phase constant values. All the harmonic coefficients may be stored in a memory to be addressed out upon command by operating the stop or tonal switches of the musical instrument.

The combined submaster data set is the set $$X'(N) = X_1(N) + X_2(N) + \ldots + X_R(N) \quad \text{(Equation 10)}$$

The master data set is then the sum of Equation 5 and Equation 10, $$Y(N) = Z(N) + X'(N) = Z(N) + X_1(N) + X_2(N) + \ldots + X_R(N). \quad \text{(Equation 11)}$$

In particular when the harmonic coefficients $c_q$ and $d_q$ are identical in Equation 6 and Equation 7 for all values of $q$, the musical tonal effect known as "doubling" is obtained. The number of harmonics, W, is a design choice, however the use of 32 harmonics ($W=32$) is satisfactory for synthesizing the "bright" tonal sounds of a musical tone synthesizer.

After both the first and second master data sets have been computed and corresponding word numbered data added together, the circuitry 10 of FIG. 1 operates by stretching the resultant data to correspond to musical notes actuated on the instrument keyboard switches 12.

Whenever a switch is actuated on the instrument keyboard switches 12, its actuation is detected by the note detect and assignor 14. The detection of an actuated key causes the assignment of a temporary memory position in 14 containing data that identifies which particular key has been actuated. Note detect and assignor 14 transmits via line 15 to executive control 16 the information that a key has been detected as having been actuated on the instrument keyboard switches 12.

Means for implementing note detect and assignor 14 are described in U.S. Pat. No. 4,022,098 entitled KEYBOARD SWITCH DETECT AND ASSIGNOR and hereby incorporated by reference. U.S. patent application Ser. No. 619,615 filed on Oct. 6, 1975, now U.S. Pat. No. 4,022,098, and commonly assigned.

The logic timing for system 10 of FIG. 1 is furnished by master clock 17. One such clock line, 18, is explicitly shown leading to executive control 16. A fairly wide range of frequencies can be used for the master clock 17; however advantageously a design choice is 1.0 Mhz. The executive control 16 transmits control signals to several of the logic blocks to synchronously time various system logic functions. Line 19 is one such line which transmits logic control signals from executive control 16 to note detect and assignor 14.

The operation of system 10 is described for binary numbers and negative values are obtained by the conventional "2's complement."

The computation cycle is defined as a repetitive event whose function is to compute Equation 5 and Equation 6. The computation cycle is composed of two subcycles, the first allocated to the computation of Equation 5; and the second allocated to the computation of Equation 6. At the beginning of a computation cycle word counter 20, harmonic counter 21, and adder-accumulator 22, are all initialized to their initial state by a clear signal created by executive control 16. That is, word counter 20 and harmonic counter 21 are set to the value "1" while adder-accumulator 22 is set to the value "0". The first subcycle of the computation cycle is called the master subcomputation cycle and the second subcycle is called the phase subcomputation cycle.

Table 1 lists the contents of the system logic blocks that are used during the computation cycle and is used to describe the operation of these blocks. At time $t=t_1$, corresponding to the first bit time of the master subcomputation cycle during which Equation 5 is computed, the word counter 20 content is number one. The harmonic counter 21 also contains the number one. The number in harmonic counter 21 is transmitted via gate 23 to adder-accumulator 22 at time $t_1$. During the master subcomputation cycle, during which Equation 5 is computed, executive control 16 transmits a signal to tone gate 24, which inhibits the transfer of the signal present in tone gate 24 to adder 26. Thus during the master subcomputation cycle, adder 26 merely transfers the content Nq in adder-accumulator 22 to memory address decoder 27. The memory address decoder 27 receives the number $Nq=1\times1$ from adder-accumulator 22 via adder 26 and causes the value $\sin[\pi(1\times1)/W]$ to be read out from the sinusoid table 28.

TABLE 1

| t | N | q | Nq | SA | HC | ADD | MR | MRC |
|---|---|---|---|---|---|---|---|---|
| 1 | 1 | 1 | 1 | (1×1) | $c_1$ | $c_1S_1$ | 1 | $c_1S_1$ |
| 2 | 2 | 1 | 2 | (2×1) | $c_1$ | $c_1S_2$ | 2 | $c_1S_2$ |
| ... | ... | ... | ... | ... | ... | ... | ... | ... |
| 64 | 64 | 1 | 64 | (64×1) | $c_1$ | $c_1S_{64}$ | 64 | $c_1S_{64}$ |
| 65 | 1 | 2 | 2 | (1×2) | $c_2$ | $c_2S_2$ | 1 | $c_1S_1+c_2S_2$ |
| 66 | 2 | 2 | 4 | (2×2) | $c_2$ | $c2S_4$ | 2 | $c_1S_2+c_2S_4$ |
| ... | ... | ... | ... | ... | ... | ... | ... | ... |
| 128 | 64 | 2 | 128 | (64×2) | $c_2$ | $c_2S_{128}$ | 64 | $c_1S_{64}+c_2S_{128}$ |
| 129 | 1 | 3 | 3 | (1×3) | $c_3$ | $c_3S_3$ | 1 | $c_1S_1+c_2S_2+c_3S_3$ |
| 130 | 2 | 3 | 6 | (2×3) | $c_3$ | $c_3S_6$ | 2 | $c_1S_2+c_2S_4+c_3S_6$ |
| ... | ... | ... | ... | ... | ... | ... | ... | ... |
| 191 | 64 | 3 | 192 | (63×3) | $c_3$ | $c_3S_{192}$ | 64 | $c_1S_{64}+c_2S128+c_3S_{192}$ |
| . | | | | | | | | |
| . | | | | | | | | |
| 1985 | 1 | 32 | 32 | (1×32) | $c_{32}$ | $c_{32}S_{32}$ | 1 | $\sum_{i=1}^{63} c_iS_i+c_{32}S_{32}$ |
| 1986 | 2 | 32 | 64 | (2×32) | $c_{32}$ | $c_{32}S_{64}$ | 2 | $\sum_{i=1}^{63} c_iS_{2i}+c_{32}S_{64}$ |
| ... | ... | ... | ... | ... | ... | ... | ... | ... |
| 2048 | 64 | 32 | 2048 | (64×32) | $c_{32}$ | $c_{32}S_{2048}$ | 64 | $\sum_{i=1}^{63} c_iS_{64i}+c_{32}S_{2048}$ |
| 2049 | 1 | 1 | 1 | (1×1)jk' | $d_1$ | $d_1S'_1$ | 1 | $d_2S'_1+\Sigma c_1S_i$ |
| 2050 | 2 | 1 | 2 | (2×1)jk' | $d_1$ | $d_1S'_2$ | 2 | $d_1S'_2+\Sigma c_iS_{2i}$ |
| ... | ... | ... | ... | ... | ... | ... | ... | ... |
| 2112 | 64 | 1 | 64 | (64×1)jk' | $d_1$ | $d_1S'_{64}$ | 64 | $d_iS'_{64}+\Sigma c_iS_{64i}$ |
| 2113 | 1 | 2 | 2 | (1×2)jk' | $d_2$ | $_2S'_2$ | 1 | $d_1S'_1+d_2S'_2+\Sigma c_iS_i$ |
| 2114 | 2 | 2 | 4 | (2×2)jk' | $d_2$ | $d_2S'_4$ | 2 | $d_2S'_2+d_2S'_4+\Sigma c_iS_{2i}$ |
| ... | ... | ... | ... | ... | ... | ... | ... | ... |
| 2176 | 64 | 2 | 128 | (64×2)jk' | $d_2$ | $d_2S'_{128}$ | 64 | $d_1S'_{64}+d_2S'_{128}+\Sigma c_iS_{64i}$ |
| . | | | | | | | | |
| . | | | | | | | | |
| 4033 | 1 | 32 | 32 | (1×32)jk' | $d_{32}$ | $d_{32}S'_{32}$ | 1 | $d_{32}S'_{32}+\sum_{i=1}^{63} d_iS'_i+\Sigma C_iS_i$ |
| 4034 | 2 | 32 | 64 | (2×32)jk' | $d_{32}$ | $d_{32}S'_{64}$ | 2 | $d_{32}S'_{64}+\sum_{i=1}^{63} d_iS_{2i}+\Sigma c_iS_{2i}$ |
| ... | ... | ... | ... | ... | ... | ... | ... | ... |
| 4096 | 64 | 32 | 2048 | (64×32)jk' | $d_{32}$ | $d_{32}S'_{2048}$ | 64 | $d_{32}S'_{2048}+\sum_{i=1}^{63} d_iS'_{64i}+\Sigma c_iS_{64i}$ |

where
t bit time in computation cycle
N content of word counter 20
q harmonic number; content of harmonic counter 21
Nq content of adder-accumulator 22
SA sine table address
ADD input to adder 2
MR current word address for input to main register
MRC content of main register at address MR
(Nxg) $\pi Nq/32$
k'1+k
j number of computation cycles module 1/k Sinusoid table 28 is coded such that the address $SA=N\times q$ causes the values $\sin[\pi(N\times q)/W]$ to be read out.

For brevity, Table 1 uses the notation $$S_{Nq} = \sin(\pi Nq/W) \qquad \text{(Equation 12)}$$

and sinusoid table 28 address is abbreviated using the symbolic notation $$(N\times q)^d = (\pi Nq/W). \qquad \text{(Equation 13)}$$

The memory address decoder 29 receives the number contained in word counter 20 to select either harmonic coefficient memory 30 or harmonic coefficient memory 31. The selection is accomplished by a modulo 32 counter connected to a bistable flip-flip and a selection gate so that when the flip-flip is in one state, the harmonic coefficient memory 30 is selected so that Equation 5 is computed. When the flip-flop is in its other state, the harmonic coefficient memory 31 is selected so that Equation 6 is computed. In addition to selecting a harmonic coefficient memory, memory address decoder 29 also addresses the appropriate harmonic coefficient corresponding to the proper harmonic number $q$ associated with each bit time in the computation cycle in response to the input data $q$. This addressing is indicated in column 4, labelled HC in Table 1.

At time $t_1$, memory address decoder 29 causes the harmonic coefficient $c_1$ to be read from harmonic coefficient memory 30. The input signals to multiplier 32 are $c_1$ on line 33 and $S_1$ on line 34. Therefore, the output of multiplier 32 is the product term $c_1S_1$.

Main register 35 is a read-write set of registers which advantageously may comprise an end-around shift register. The contents of main register 35 are initialized to a zero value at the start of the computation cycle. At time $t_1$, the value $c_1S_1$ is placed into word address 1 of main register 35.

At the second bit time $t_2$, word counter 20 is incremented to the value 2 by a signal received from executive control 16. The harmonic counter 21 is maintained at the value of 1 and will retain this value during the first 64 bit times of the computation cycle. Adder-accumulator 22 receives the current value of $q$ from harmonic counter 21 via gate 23 at each bit time. Therefore at time $t_2$, adder-accumulator 22 has the value $Nq=2$. Because tone gate 24 is inhibited during the master subcomputation cycle, adder 26 transmits the current value $Nq=2$ from adder-accumulator 22 to memory address decoder 27. Therefore the value $S_2$ corrrsponding to the address $(2\times1)$ is transferred from sinusoid table 28 to multiplier 32. At time $t_2$, the harmonic coefficient $c_1$ is read from harmonic coefficient memory 30. The output signal from multiplier 32 is the value $c_1S_2$ which is added by adder 36 to the initial zero value of word No. 2 in main register 35 so that the net result is that the value $c_1S_2$ is placed into word No. 2 at time $t_2$.

The first subroutine of the master subcomputation cycle is iterated for 64 bit times. At the end of the first subroutine, indicated by the horizontal line, the contents of main register 35 are the first 64 values indicated in Table 1 under the column heading MRC (Main Register Content).

Time $t_{65}$ initiates the second subroutine of the master subcomputation cycle. At time $t_{63}$, word counter 20 returns to its initial value of one and generates a Reset signal because this device is a counter modulo 2W, and W has been selected to have the value 32. The resetting of word counter 20 is detected from the reset signal by adder-accumulator 22 and causes the accumulator to return to an initial value of zero. The Reset signal from word counter 20 is used to increment the count in harmonic counter 21 so that it now contains the value $q=2$. Harmonic counter 21 will retain the value $q=2$ for the 64 successive bit times comprising the second subroutine of the master subcomputation cycle. Therefore at time $t_{65}$, adder-accumulator 22 has the value $Nq=2$. Because tone gate 24 is inhibited during the master subcomputation cycle, adder 26 transmits the current value $Nq=2$ from adder-accumulator 22 to memory address decoder 27. Hence the value $S_2$ corresponding to the address $(1\times2)$ is transferred from sinusoid table 28 to multiplier 32. At time $t_{65}$, the harmonic coefficient $c_2$ is read from harmonic coefficient memory 30. The output signal from multiplier 32 is the value $c_2S_2$ which is added by means of adder 36 to the value $c_1S_1$ which at time $t_{65}$ resides in word No. 1 of main register 35. The sum $c_1S_1+c_2S_2$ is placed in storage in word No. 1 of main register 35 at time $t_{65}$.

The second subroutine of the master subcomputation cycle is iterated for 64 bit times. At the end of this second subroutine, indicated by the second horizontal line in Table 1, the contents of main register 35 are the 64 values indicated in Table 1 under the heading MRC lying between the first and second horizontal lines.

Time $t_{129}$ initiates the third subroutine of the master subcomputation cycle. At time $t_{129}$ word counter 20 returns to its initial value of one and generates a Reset signal. The Reset signal causes adder-accumulator 22 to be initialized to zero value and causes the content of harmonic counter 21 to be incremented to the value $q=3$. Harmonic counter 21 will retain the value $q=3$ for the 64 successive bit times comprising the third subroutine of the master subcomputation cycle. Therefore, at time $t_{129}$ adder-accumulator 22 has the value $Nq=3$. Adder 26 transmits the current value $Nq=3$ from adder-accumulator 22 to memory address decoder 27. Hence the value $S_3$ corresponding to the address $(1\times3)$ is transferred from sinusoid table 28 to multiplier 32. At time $t_{129}$, the harmonic coefficient $c_3$ is read from harmonic coefficient memory 30. The output signal from multiplier 32 is the value $(c_1S_1+c_2S_2)$ which at time $t_{129}$ resides in word No. 1 of main register 35. The sum $(c_1S_1+c_2S_2+c_3S_3)$ is placed in storage in word No. 1 of main register 35 at time $t_{129}$.

The third subroutine of the master subcomputation cycle is iterated for 64 bit times. At the end of this third subroutine, indicated by the third horizontal line in Table 1, the contents of main register 35 are the 64 values indicated in Table 1, under the heading MRC lying between the second and third horizontal lines. The various sequential subroutines of the master subcomputation cycle proceed in a manner analogous to the first three subroutines previously described until the end of the 64th such subroutine which is initiated at time $t_{1985}$. The data entries for this last subroutine are listed just above the double horizontal line in Table 1. At the end of this last subroutine the values in each of the address numbers, or words, in main register 35 are the values proscribed by Equation 5 where the argument N for Z(N); $N=1,2,\ldots,64$ corresponds to the main register address numbers.

At time $t_{2049}$ the first subroutine of the second portion of the computation cycle, or phase subcomputation cycle, is initiated under command from executive control 16. During the phase subcomputation cycle, Equation 6 will be computed and the values X(N) will be added to the values Z(N) which already reside in main register 35 at the end of the master subcomputation cycle. At time $t_{2049}$ word counter 20 and harmonic counter 21 are initialized to contain the value "one" and adder-accumulator 22 is initialized to be the value "zero."

During the entire phase subcomputation cycle, tone gate 24 is caused by executive control 16 to transfer input data received from scaler 25 to adder 26. At time $t_{2049}$, the value $Nq=1$ is contained in adder-accumulator 22 and is transferred as one input to adder 26 and as well to scaler 25. Scaler 25 multiplies the input value $Nq$ by a constant $jk$ and transmits the result $jkNq$ to tone gate 24. A means for implementing scaler 25 is shown in FIG. 2 and is described below. The value $k$ is selectable and is chosen by means of a k select control signal input to scaler 25 on line 38. The value $j$ is the number contained in cycle counter 37. Cycle counter 37 is incremented by executive control 16 at the bit time which initiates the phase subcomputation cycle. Adder 26 sums the value $Nq=1$ received from adder-accumulator 22 with the value $jkNq=jk\times1$ received from tone gate 24. The sum $Nq(1+jk)=1+jk$ is used by memory address decoder 27 to cause the value $S_{Nq(1+jk)}=S_{1+jk}$ to be read from sinusoid table 28. For brevity in Table 1, the notation adapted is $jk'=1+jk$ and $S_{Nqjk'}=S_{Nq}'$. With the defined notation, the value read from sinusoid table 28 at time $t_{2049}$ is $S_1'$. Executive control 16, during the entire phase subcomputation cycle, directs memory address decoder 29 to address harmonic coefficients $d_q$ from harmonic coefficient memory 31. At time $t_{2049}$, memory address decoder 29 causes the harmonic coefficient $d_1$ to be read from harmonic coefficient memory 31. The output signal from multiplier 32 is the value $d_1S_1'$ which is added by adder 36 to the value $\Sigma c_iS_i$ that already resides in word No. 1 of main register 35 and at time $t_{2049}$ the value $d_1S_1'+\Sigma c_iS_i$ is placed into word No. 1 of the main register.

The first subroutine of the phase subcomputation cycle is iterated for 64 bit times. At the end this first subroutine, indicated by the horizontal line following the double horizontal line, the contents of main register 35 are the 64 values in Table 1 listed under the column heading MRC.

For notational convenience, all summations in Table 1 and in the description which do not explicitly show the summation index or the summation range are intended to be summations on the index $i$ over the range $i=1$ to $i=64$.

Time $t_{2113}$ initiates the second subroutine of the phase subcomputation cycle. At time $t_{2113}$ word counter 20 returns to its initial value of one and generates a Reset signal. The Reset signal causes adder-accumulator 22 to be initialized to zero value and causes the content of harmonic counter 21 to be incremented to the value $q=2$. Harmonic counter 21 will retain the value $q=2$ for the 64 successive bit times comprising the second subroutine of the phase subcomputation cycle. Therefore at time $t_{2113}$, adder-accumulator 22 has the value $Nq=1\times2=2$. This value of $Nq=2$ is transferred as one input to adder 26 as well as the input to scaler 25. Scaler 25 causes the value $jk\times2$ to be transferred via tone gate 24 as a second input to adder 26. The sum $2+2jk$ is furnished by adder 26 to memory address decoder 27 which in turn uses the sum value to cause the value $S_{2(1+jk)}=S_2'$ to be read from sinusoid table 28. At time $t_{2113}$, memory address decoder 29 causes the harmonic coefficient $d_2$ to be read from harmonic coefficient memory 31. The output signal from multiplier 32 is the value $d_2S_2'$ which is added to the value $d_1S_1'+c_iS_i$ that already resides in word No. 1 of main register 35. Thus, at time $t_{2113}$ the value $(d_1S_1'+d_2S_2')+c_iS_i$ is placed into word No. 1 of the main register.

The second subroutine of the phase subcomputation cycle is iterated for 64 bit times. At the end of this second subroutine, indicated by the second horizontal line following the double horizontal line, the contents of main register 35 are the 64 values in Table 1 listed under the column heading MRC.

The various sequential subroutines of the phase subcomputation cycle proceed in a manner analogous to the first two subroutines previously described until the end of the 64th such subroutine which is initiated at time $t_{4033}$. The data entries for this last subroutine are listed at the end of Table 1. At the end of said last subroutine, the values in each of the address numbers, or words, in main register 35 are the values proscribed by the sum Z(N) of Equation 5 and X(N) of Equation 6, for $N=1,2,\ldots,64$.

At the completion of both portions of the computation cycle, master subcomputation cycle and phase subcomputation cycle, executive control 16 initiates the start of the data transfer cycle. During the data transfer cycle, the contents of main register 35 are transferred in a carefully controlled manner to note shift registers 39 and 40. While the description of the data transfer cycle is illustrated for two note shift registers, the extension to any multiplicity is apparent to those skilled in the art of logic design.

Each note shift register has its own separate bit position for a synchronizing bit. This bit position is always a "1" for a single word and is "0" for all other words. The synchronizing bit is used by various logic blocks to detect the initial phase state of the end-around note shift registers as described below. More generally, the synchronizing data may consist of a synchronizing time data word.

When a first key has first been actuated on the instrument keyboard switches 12, a note clock 41 is assigned by note detect and assignor 14. The note clocks 41 and 42 may not be locked with master clock 17 and run asynchronously. Note detect and assignor 14 when it detects the closure of a keyboard switch causes a transfer of a control voltage, or detection signal, to each assigned note clock which causes these clocks to operate at a rate of 64 times the fundamental frequency corresponding to the keys actuated on the instrument keyboard.

A preferred implementation is to use a VCO (Voltage Controlled Oscillator) for note clocks 41 and 42. Means for advantageously implementing these VCO are described in U.S. Pat. No. 4,067,254 entitled FREQUENCY NUMBER CONTROLLED CLOCKS hereby incorporated by reference.

Note clocks 41 and 42 cause their respective note shift registers 39 and 40 to transfer data end-around at their individual clock rates. When the word containing the synchronizing bit is read from note shift register 39, its presence is detected by synchronizing bit detector 43. When a synchronizing bit is detected, a phase time is initiated and a phase time signal is sent to note select 44 via line 45 which identifies the particular note shift register and serves to initiate the first subcycle of the data transfer cycle. Once the first subcycle has been initiated, it cannot be terminated by the detection of another synchronizing bit by synchronizing bit detector 43; for example from note shift register 40.

At the start of the first subcycle of the data transfer cycle, note select 44 uses the information received via line 45 to cause the output signal on line 46 from clock select 47 to change from master clock 17 to the clock rate generated by note clock 41. The word contents of main register 35 are then transferred sequentially to note select 44 via line 48. Note select 44 sends this data to load select 49. The load select logic blocks 49 and 50 either operate to load new data into their associated note shift registers or to permit these registers to operate in an end-around mode when the corresponding data transfer subcycle has been completed.

After note register 39 has been loaded with data transferred from the main register 35 at the clock rate determined by note clock 41, the first subcycle of the data transfer cycle is completed. The second subcycle is initiated the next time that a synchronizing bit is detected by synchronizing bit detector 43 from the data being read from note shift register 40. The operation of the second subcycle is analogous to the first subcycle with note clock 42 now used for timing the transfer of data from main register 35.

At the conclusion of the data transfer cycle, executive control 16 initiates a new computation cycle and causes cycle counter 37 to be incremented. While the next new computation cycle is underway, data is being read independently from both note shift registers 39 and 40 under control of their individual note clocks 41 and 42. By the described means, the master data set computed and temporarily stored in main register 35 has been stretched to correspond to a musical waveform at note frequencies corresponding to switches actuated on the keyboard.

The output data from each note shift register 39 and 40 is converted to an analog voltage by means of digital-to-analog convertors 51 and 52. Typical musical waveshapes appearing on lines 13 and 53 are shown in FIG. 2. The two signals from the two digital-to-analog convertors 51 and 52 are summed in sound system 11 and the sum is used to create the audible musical sounds.

The computation cycle and the data transfer cycle are independent of each other but are programmed to operate sequentially. During a computation cycle, the output musical tones are continuously generated and are not interrupted. Moreover, during the data transfer cycle, the individual tones are not interrupted so that the musical tones do not have any discontinuities if the harmonic coefficients used to create the master data set have not been changed. If a control is opened such as either switch 54 or 55, the tone quality will change at the completion of the next subsequent computation cycle and data transfer cycle. Switches 54 and 55 are commonly called "stops" or tone switches.

The sinusoid table 28 may comprise a read only memory storing values of $\sin(\pi\phi/W)$ for $0 \leqq \phi \leqq 2W$ at intervals of D, where D is called the resolution constant of the memory. D determines the minimum phase shift that can be given to the data X(N), Equation 6, as computed in any computation cycle. The smaller the resolution constant the smaller is the corresponding minimum phase shift. The memory address decoder 27 accesses from the sinusoid table 28 the value $\sin[\pi Nq(1+jk)/W]$ corresponding to the argument $Nq(1+jk)$ received from adder 26. During the master subcomputation cycle, the phase constant $k=0$. It may happen that a value of $Nq(1+jk)$ present in adder 26 does not correspond exactly to a stored sine value. In such instance, the memory address decoder 27 may round off the value $Nq(1+k)$ so as to access from the sinusoid table 28 the closest stored sine value. Alternatively, the memory address decoder 27 may access the next lower sine value address, or the next higher such value. Of course, the smaller the resolution constant D, and hence the greater the number of entries in sinusoid table 28, the smaller will be the round off error in evaluating the term $\sin[\pi Nq(1+jk)/W]$. For organ tone systems, a sinusoid table having 256 entries is a satisfactory design and corresponds to a resolution constant $D=360/256=1.40625°$.

Figure 3A:
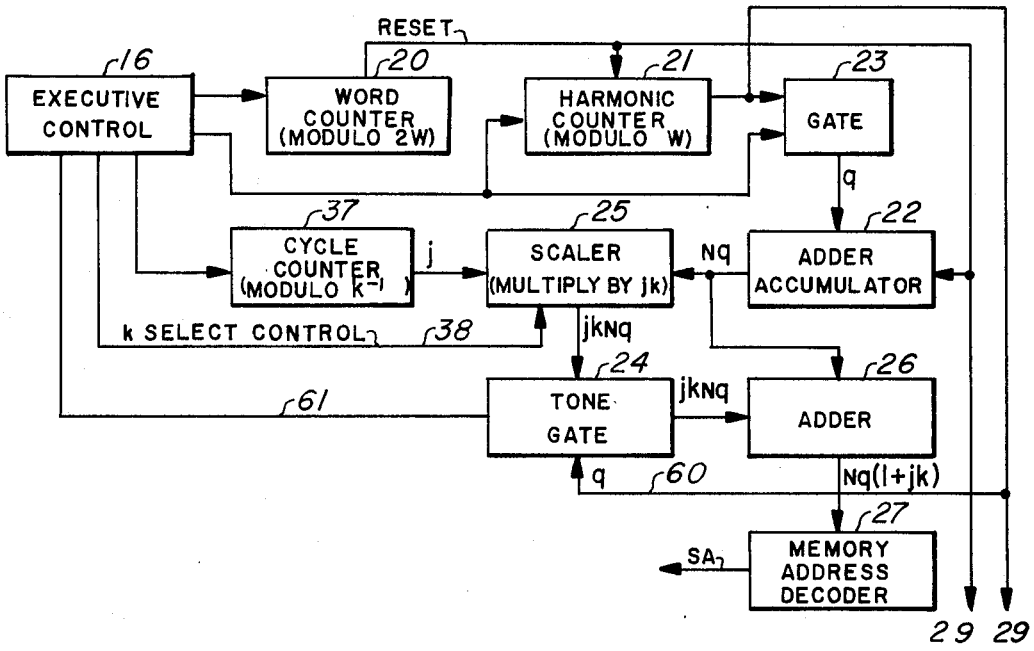
FIG. 3*a* is an electrical block diagram for implementing anharmonic overtones.
Figure 3B:
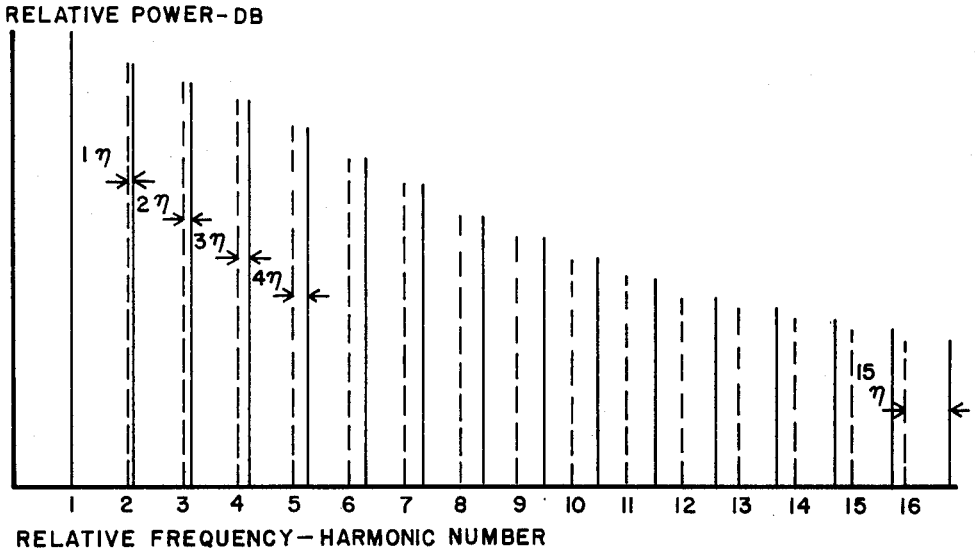
FIG. 3*b* illustrates the harmonic number and overtone relation for anharmonic overtones.

A modification to system 10 of FIG. 1 is shown in FIG. 3*a*. This modification accomplishes the generation of anharmonic overtones as illustrated in FIG. 3*b*. In FIG. 3*b*, the abcissa represents relative frequency for a musical waveshape. The true harmonic positions occur at equal spacing as drawn in the figure by the dashed lines. The system shown in FIG. 3*b* and described below causes the first harmonic, or fundamental, frequency to remain at the true frequency while each of the higher harmonics is caused to be generated at a higher frequency that that of the true harmonic thus causing the corresponding generated tone to have anharmonic overtones rather than true harmonics. The values $1\eta, 2\eta, 3\eta, \ldots, 15\eta$ denote the detuning of each of the harmonics. The ordinates in FIG. 3*b* represent the relative strength of the harmonics in a typical musical waveshape as measured in power units relative to the fundamental, or first harmonic component. Anharmonic overtones can also be generated wherein the frequency offsets are at a lower frequency than those of the true harmonic frequencies.

The system 10 modification shown in FIG. 3*a* can be used to generate ensemble as described previously, anharmonic overtones for all tones, or a combination of ensemble and anharmonic overtones. The principal modification of the system 10 of FIG. 1 is in tone gate 24. An additional input is made via line 60 to furnish the current value of the harmonic number $q$ to tone gate 24. When system 10 is used to generate ensemble as previously described with reference to FIG. 1, tone gate 24 operates as previously described and does not make use of the current harmonic coefficient $q$.

If system 10 is used to generate anharmonic overtones without ensemble, executive control 16 causes the system logic blocks to operate in the following manner. Word counter 20, harmonic counter 21, gate 23, adder-accumulator 22, scaler 25, adder 26, memory address decoder 27, and cycle counter 37 all function as previously described for system 10 with reference to FIG. 1. The major change to produce anharmonic overtones, is that, with a certain restriction, tone gate 24 is not inhibited during either the master subcomputation cycle of the phase subcomputation cycle of the computation cycle. However, during both the master subcomputation cycle and phase subcomputation cycle of the computation cycle, tone gate 24 is inhibited for input values of $q=1$ on line 60. The net result is that instead of Equations 5 and 6, the master data set represents the calculation of data from the following equations $$Z'(N) = c_1 \sin(\pi N/W) + \sum_{q=2}^{W} c_q \sin[\pi Nq(1+jk)/W] \quad \text{(Equation 14)}$$

$$X'(N) = d_1 \sin(\pi N/W) + \sum_{q=2}^{W} d_q \sin[\pi Nq(1+jk)/W] \quad \text{(Equation 15)}$$

where $j$ is an integer that is incremented at the start of each computation cycle.

The modification of system 10 shown in FIG. 3*a* can be used to simultaneously generate musical tones that have anharmonic overtones and are at different frequencies thereby also creating an ensemble effect. The simultaneous effect is created by causing $k$ select control on line 38 to change the value of $k$ used by scaler 25 on various portions of the computation cycle. During the master subcomputation cycle, tone gate 24 operates as described in the preceding paragraph to create the values of Z'(N) in the master data set as prescribed by Equation 9. During the phase subcomputation cycle, the following values X''(N) are generated and added to the values of Z'(N) that exist in the main register 35 as a result of the master subcomputation cycle.

$$X''(N) = d_1 \sin[\pi N(1+jk_2)] + \sum_{q=2}^{W} d_q \sin\{\pi Nq[1+j(k+k_2)/W]\} \quad \text{(Equation 16)}$$

where $k$ corresponds to the phase shift constant that produces the anharmonic overtones and $k_2$ corresponds to the phase shift constant that produces the ensemble effect between the data points Z'(N) and X''(N).

While both FIG. 1 and FIG. 3*a* were described for ensemble and anharmonic generation in which the frequencies were offset to a higher frequency, it is an obvious modification to produce these musical effects in which the offsets are made to lower frequencies. Mathematically the modification is simply to use a negative value for the phase shift constants $k$ and $k_2$. This change can be accomplished by replacing adder 26 in FIG. 1 and FIG. 3*a* by a subtractor. A common means to mechanize such a subtraction operator is to complement (2's complement) the data $jkNq$ which is one of the input data lines to adder 26.

System 10 as shown in FIG. 1 and described previously requires $32 \times 64 = 2048$ bit times to compute the Z(N) and the X(N) components of the master data set. An economy in calculation time for the components X(N) can be achieved by restricting the number of harmonics $q$ used in the evaluation of Equation 6. If Equation 6 is replaced by $$X(N) = \sum_{q=1}^{M} d_q \sin[\pi Nq(1+jk)/W] \quad \text{(Equation 17)}$$

where the number of harmonics M is less than, or equal to, the number of harmonics W used to compute Z(N) according to Equation 5, then the number of bit times required for the phase subcomputation cycle time is $M \times 64$. Satisfactory ensemble effects can be attained with a value of $M=8$. For this value of $M=8$, the number of bit times in the phase subcomputation cycle is $8 \times 64 = 512$. Executive control 16 can readily be modified so that Equation 17 can be implemented during the phase subcomputation cycle for any value of M, which specifies the number of harmonics used for the ensemble, or out-of-tune, tone. The out-of-tune tone is the X(N) component of the master data set. These components are also called the out-of-tune submaster data set.

A description of synchronization bit detector 43 shown in FIG. 1 is contained in U.S. Pat. No. 4,085,644.

Figure 4A:
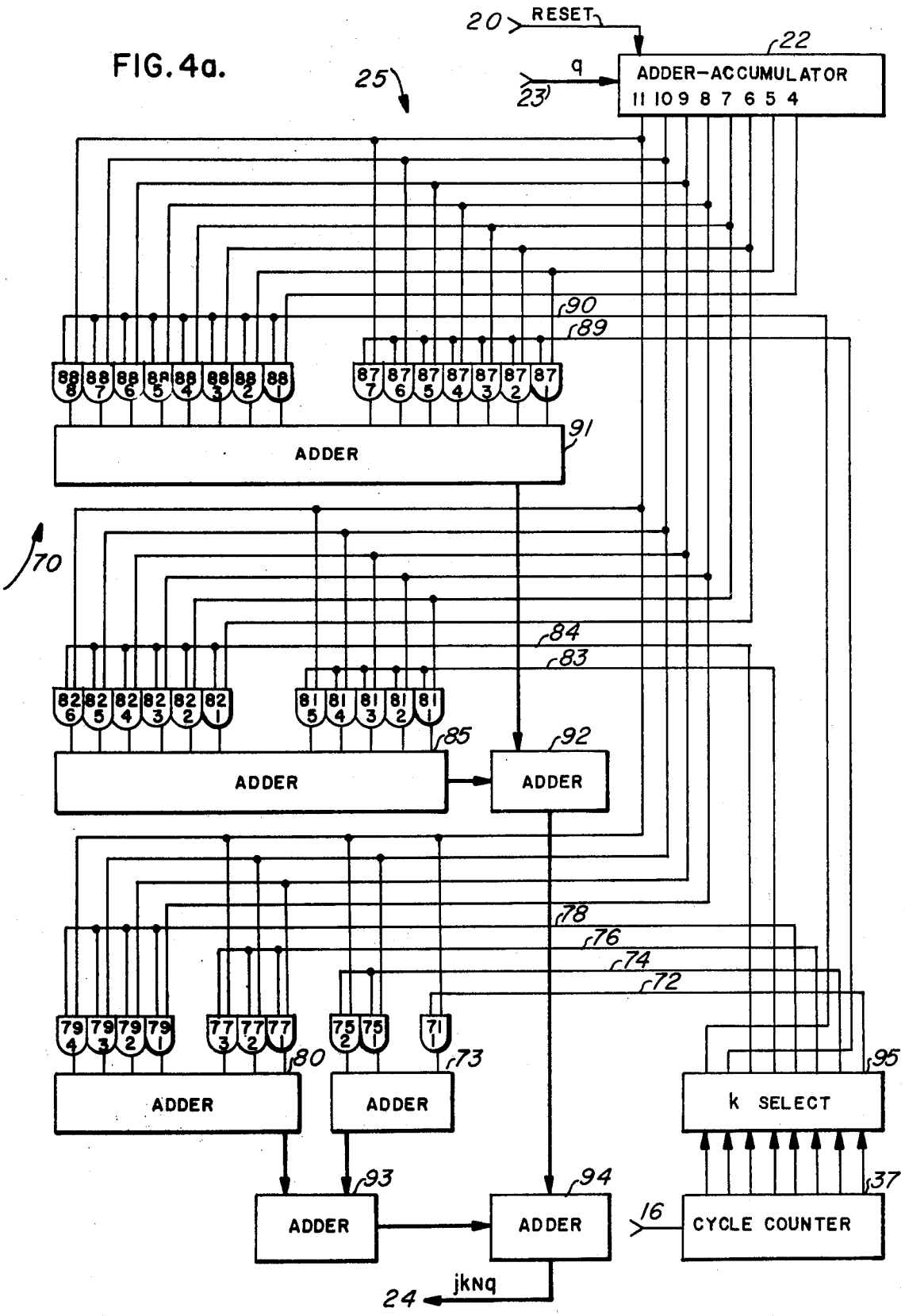
FIG. 4*a* shows the logic diagram for implementing a scaler.

FIG. 4a shows a means for implementing scaler 25. The function of scaler 25 is to multiply N$q$ by the multiplier $jk$, where $k$ is a phase shift constant whose selection is either a system design constant or is selectable by the musician via executive control 16. The value of $k$ is a factor determining the amount of "out-of-tune" for the out-of-tune submaster data set. $j$ is obtained from cycle counter 37 which is incremented by executive control 16 at the start of each computation cycle. Equation 6 states that the phase shift for X(N) will occur at increments of $\Delta\phi = \pi Nqjk/W$. Since $N=2W$, then for the fundamental frequency $q=1$, $\Delta\phi = 2\pi jk$. The minimum value of $\Delta\phi$ corresponds to $j=1$, or $\Delta\phi(\min) = 2\pi k$ radians, corresponding to $\Delta\phi(\min) = 2k \times 180°$. For a sinusoid table resolution $D = 1.40625°$, $k = 2^{-8}$. The required maximum value of $j$ is that which makes $\Delta\phi = 2\pi$, or $$\Delta\phi(\max) = 2\pi = \pi Nqkj(\max)/W. \quad \text{(Equation 18)}$$

Equation 18 implies $j(\max) = k^{-1}$, for $N=2W$ and $q=1$. Therefore cycle counter 37 is a counter modulo $k^{-1}$. For $k=2^{-8}$, cycle counter 37 is modulo $2^8=256$.

For $N=1,2,\ldots,64$ and $W=32$, the maximum number of bits in adder-accumulator 22 will be 11 as shown in FIG. 4a. Scaler 25 comprises eight sets of AND gates 70 which are controlled by binary signals generated by cycle counter 37. AND gate 71-1, when a one signal appears on line 72 causes the 11th bit of the data word N$q$ received from adder-accumulator 22 to be transferred as one input to adder 73. Bit number 1 is the LSB for data word N$q$, therefore AND gate 71-1 causes a division of 1024. When a one signal appears on line 74, the AND gates 75-1 and 75-2 cause the 11th and 10th bits of N$q$ to be transferred as the second input to adder 73. Gates 75-1 and 75-2 effect a division of 512 on data word N$q$.

The set of AND gates 77-1 through 77-3 cause a division of 256 of data word N$q$ transferred as one input to adder 80 under control of the signal on line 76. The set of AND gates 79-1 through 79-4 cause a division of 128 of data word N$q$ transferred as a second input to adder 80 under control of the signal on line 78.

The set of AND gates 81-1 through 81-5 cause a division of 64 of data word N$q$ transferred as one input to adder 85 under control of the signal on line 83. The set of AND gates 82-1 through 82-6 cause a division of 32 of data word N$q$ transferred as a second input to adder 85 under control of the signal on line 84.

The set of AND gates 87-1 through 87-7 cause a division of 16 of data word N$q$ transferred as one input to adder 91 under control of the signal on line 89. The set of AND gates 88-1 through 88-8 cause a division of 8 of data word N$q$ transferred as a second input to adder 91 under control of the signal on line 90.

The output data from adder 91 and adder 85 are summed in adder 92. The output data from adder 80 and adder 73 are summed in adder 93. The output data from adder 92 and adder 93 are summed in adder 94 which yields the desired multiplication product data $sk$N$q$. The tree of adders permits the addition of all the necessary combinations of the binary fractions of data word N$q$ to yield $jk$N$q$.

Figure 4B:
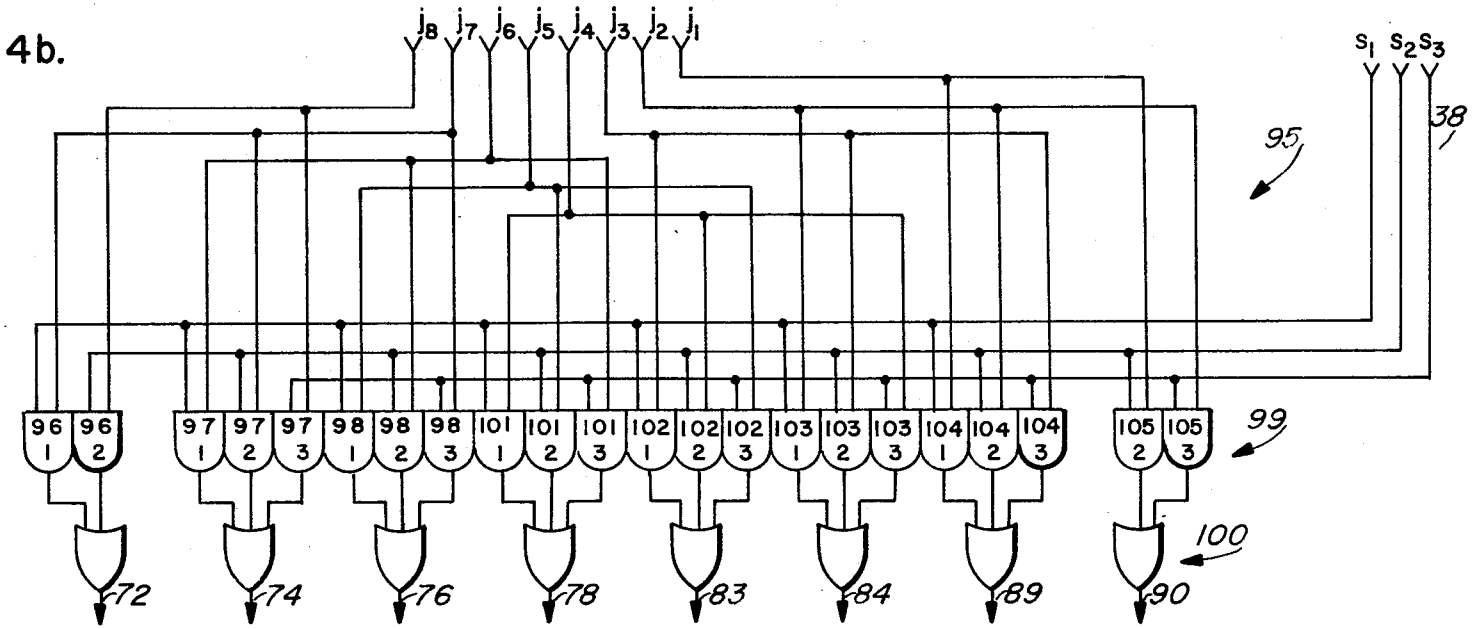
FIG. 4*b* shows a means for varying the phase constant $k$ in a scaler.

FIG. 4b shows the logic used to implement $k$-select 95. A set of AND gates 99 and a set of OR gates 100 act cooperatively to effect a right, left, or no shift of the binary data bits $j_1$ through $j_8$ output from cycle counter 37. The number of binary positions shifted is designated by the value of a number $u$. $u=1$ denotes a right shift of one binary bit; $u=0$ denotes no shift; and $u=1$ denotes a left shift of one binary bit. The shift control is introduced to scaler 25 from executive control 16 via line 38. If the shift control bits $s_1=0$, $s_2=1$ and $s_3=0$, then AND gates 96-2, 97-2, 98-2, 101-2, 102-2, 103-2, 104-2, and 105-2 transfer data on line $j_8$ through $j_1$ to lines 72, 74, 76, 78, 83, 84, 89, 90 with no change in the order of the bits. If $s_1=0$, $s_2=0$, $s_3=1$ then AND gate 97-3 causes the input on line $j_8$ to appear on line 74, AND gate 98-3 causes the input on line $j_7$ to appear on line 76. The other AND gates in logic 99 with a "dash three" index all function similarly so that the net result is the output data from OR gates 100 are right shifted ont bit position. Such a right shift causes the value of $k$ as generated by scaler 25 to be halved.

The logic shown in FIG. 4b can be readily extended to obtain other values of the shift parameter $u$. The extension consists of employing additional AND gates in the set of gates 99.

If $s_1=1$, $s_2=0$, $s_3=0$, all the "dash one" indexed OR gates in 100 cause the input data to appear on the output lines shifted one bit position to the left. Such a left shift causes the value of $k$ as generated by scaler 25 to be doubled.

Other types of conventional multipliers can be used to implement scaler 25 and can be used to obtain a range of values of $k$ without the limitation of doubling or halving as described previously. In musical systems the value of $k$ is not a very critical parameter and a range of values corresponding to $k/2, k$, and $2k$ is usually adequate.

An economy in the number of bit times required to create a master data set during the computation cycle can be achieved if the ensemble effect is created by the musical technique known as doubling. In a doubled musical system, each tone is created two times. One tone is at the nominal pitch and usually the second identical tone is at a slightly higher pitch. Sometimes the second tone may be created at a lower pitch. Doubling is achieved in the subject invention by generating the components X(N), defined in Equation 6, while using the same harmonic coefficients $c_q$ used to generate the components Z(N) defined in Equation 5. When $d_q = c_q$, Equations 5 and 6 can be combined to obtain the expression $$V_N = \sum_{q=1}^{W} c_q \{\sin(\pi Nq/W) + \sin[\pi Nq(1+jk)/W]\} \quad \text{(Equation 19)}$$

Figure 5:
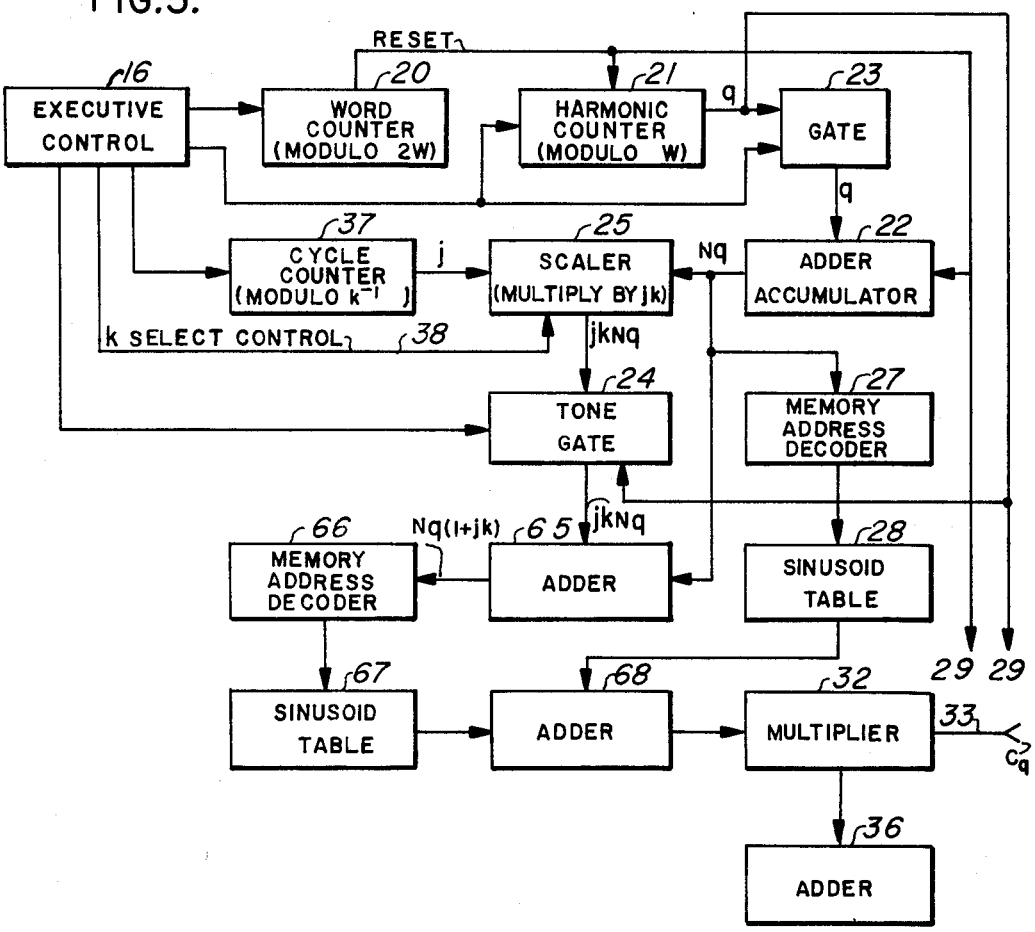
FIG. 5 is an electrical block diagram of an alternative means for implementing doubling in a polyphonic tone synthesizer.

FIG. 5 shows a means for implementing doubling as defined in Equation 14 and utilized in conjunction with U.S. Pat. No. 4,085,644 previously described. The input to memory address decoder 27 is the data word N$q$. Consequently the sinusoid value $S_{Nq}=\sin(\pi Nq/W)$ is addressed from sinusoid table 28 and appears as one input to adder 68. When the subsystem shown in FIG. 5 is used only for doubling, tone gate 24 is directed by executive control 16 to simply transfer all its input data words $jk$N$q$, without any inhibiting, to one input of adder 65. The second input to adder 65 is the data word N$q$. Therefore the input data word to memory address decoder 66 is N$q(1+jk)$. Memory address decoder 66 causes the sinusoid value $S_{Nq}'=\sin[\pi Nq(1+jk)/W]$ to be read from sinusoid table 67 and transferred as the second data input to adder 68. Adder 68 sums its two inputs to produce the sum $s=\sin(\pi Nq/W)+\sin[\pi Nq(1+jk)/W]$. The sum $s$ is one input to multiplier 32 and the harmonic coefficient $c_q$ is the second input. Hence, the data signal $c_q s$ is provided as one input to adder 36.

The computation cycle for the doubling subsystem shown in FIG. 5 requires $Nq=64\times 32=2048$ bit times. This number of bit times is one half that required for an ensemble effect in which the harmonic coefficients $c_q$ differ from the harmonic coefficients $d_q$.

The doubling subsystem shown in FIG. 5 can also be used to generate musical tones which are doubled and have anharmonic overtones. The means for creating anharmonic overtones for the doubling subsystem shown in FIG. 5 is analogous to the means for creating anharmonic overtones shown in FIG. 3$a$ and previously described. For the fundamental, or first harmonic $q=1$, $k$ select control causes scaler 25 to multiply the input data N$q$ by a factor $k_1$. For all other harmonics, $k$ select control causes scaler 25 to multiply the input data by a factor $k_2$ which differs from $k_1$.

The function of tone gate 24 in FIG. 5 is to provide a means for inhibiting the doubling effect when it is not desired by the musician.

Figure 6:
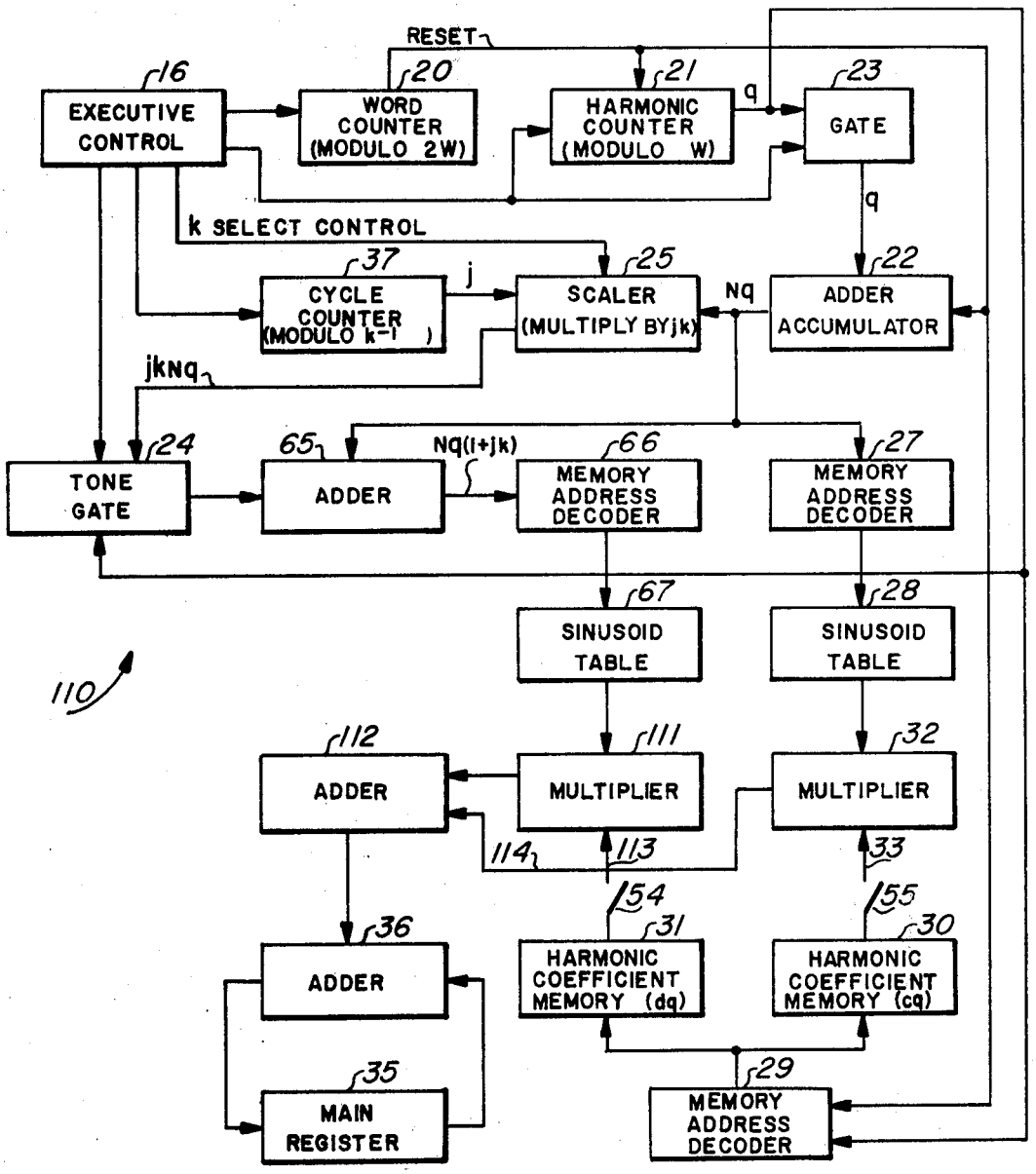
FIG. 6 is a block diagram of a parallel processing alternative means to produce ensemble.

A means for reducing the number of bit times required to create a master data set corresponding to Equations 5 and 6 is shown in FIG. 6. The illustrated subsystem employs parallel processing channels in which one is used to generate the data words Z(N) defined by Equation 5 and the second is used to simultaneously generate the data words X(N), the out-of-tune submaster data set, defined by Equation 6. In system 10 shown in FIG. 1 and described previously, the summation of the data words Z(N) and X(N) was accomplished by the combination of adder 36 and main register 35. In system 110 shown in FIG. 6 and described below, the data words Z(N) and X(N) are generated simultaneously and summed before transmitted as input data to adder 36.

During the computation cycle, memory address decoder 29 as used as an element of system 110 shown in FIG. 5, causes the simultaneous read out of harmonic coefficients $c_q$ and $d_q$ from their respective harmonic coefficient memories 30 and 31. The input data to multiplier 32 is the harmonic coefficient $c_q$ and the sinusoid value $S_{Nq}=\sin(\pi Nq/W)$. The product output $c_q S_{Nq}$ is transferred as one input to adder 112. Similarly, memory address decoder 66 causes the sinusoid value $S_{Nq}'=\sin[\pi Nq(1+jk)/W]$ to appear as one input to multiplier 111. The second input to multiplier 111 is the harmonic coefficient $d_q$. Hence the second input to adder 112 is the product $d_q S_{Nq}'$. The sum $s=c_q S_{Nq}+d_q S_{Nq}'$ is the data input to adder 36. Adder 36 in combination with main register 35 uses the sum $s$ to create the master data that is stored in main register 35.

The computation cycle for system 110 shown in FIG. 6 and described above requires $Nq=64\times 32=2048$ bit times or a factor of two reduction compared with system 10 shown in FIG. 1. Further parallel processing channels can readily be added to system 110 to permit parallel processing of additional harmonic coefficient sets. Each such channel evaluates a submaster data set defined analagous to Equation 6. These sets are also called the out-of-tune submaster data sets to differentiate them from the set consisting of the "in-tune" data Z(N) corresponding to Equation 5. System 110 can also be used to create anharmonic overtones in the same manner previously described for system 10 by using tone gate 24 in combination with the $k$ select control input to scaler 25.

System 120 shown in FIG. 7 and described below is an alternative modification of system 10 such that the number of bit times required for the computation cycle is reduced from that required with system 10 shown in FIG. 1. System 120 utilizes the characteristic that the data points Z(N) as defined by Equation 5 remain invariant during each successive computation cycle unless the harmonic coefficients $c_q$ are caused to change. It is only the data points X(N) as defined by Equation 6 that change for each successive computation cycle. Using this characteristic, system 120 operates with two types of computation cycles. The first type is called the normal computation cycle and is the type that is used in conjunction with system 10. That is, a normal computation cycle consists of a master subcomputation cycle during which the components Z(N) as described by Equation 5 are evaluated and a phase subcomputation cycle during which the components X(N) as described in Equation 6 are evaluated. The normal computation cycle as used in system 120 does not include the step in system 10 of adding the components of X(N) to those of Z(N) in main register 35. System 120 also has a second computation cycle called the phase computation cycle during which only the components X(N) are generated and used to create a master data set which is called the phased master data and resides in phase register 122. The second computation cycle is the phase subcomputation cycle of a normal computation cycle.

Initially system 120 operates until one normal computation cycle is completed. Each succeeding computation cycle is a phase computation cycle. Such phase computation cycles are repeated successively until stop change detector 124 detects that a stop switch has changed state. Such a state change detection causes system 120 to initiate a new normal computation cycle which is immediately followed by successive phase computation cycles.

During the master subcomputation cycle of a normal computation cycle, tone gate 24 is inhibited by executive control 16 so that the output from multiplier 32 are the components $Z_{Nq}=c_q \sin(\pi Nq/W)$. Phase gate 121 is directed by executive control 16 to transfer all the data produced by adder 36 to main register 35. Phase register 122 acts as an end-around shift register so that at the end of the master subcomputation cycle of a normal computation cycle a master data set consisting of the data components Z(N) exists in both main register 35 and phase register 122.

At the start of the phase subcomputation cycle of a normal computation cycle the contents of phase register 122 are initialized to zero, tone gate 24 transfers its input data to adder 26, and phase gate 121 acts to inhibit its input data. Because phase gate 121 is inhibited, the master data set residing in main register 35 remains unchanged. Since tone gate 24 now transfers its input data, the output data from multiplier 32 are the components $X_{Nq}=d_q \sin[\pi Nq(1+jk)/W]$. During the phase subcomputation cycle of a normal computation cycle, a phased master data set consisting of the components X(N) resides in phase register 122.

During a data transfer cycle, data words are addressed and read out simultaneously from phase register 122 and main register 35. These data are summed in adder 123 and the sum is transmitted to note select 44.

If no stop switches have changed state since the preceding normal computation cycle, the executive control will initiate a phase computation cycle at the conclusion of all subcycles of the data transfer cycle. During a phase computation cycle, only the phase data residing in phase register 122 is recreated. This is accomplished by causing phase gate 121 to inhibit its input data from adder 36, thereby preserving and leaving unaltered the master data set Z(N) residing in main register 35. A phase computation cycle is equivalent to the second portion of a normal computation cycle.

Figure 7:
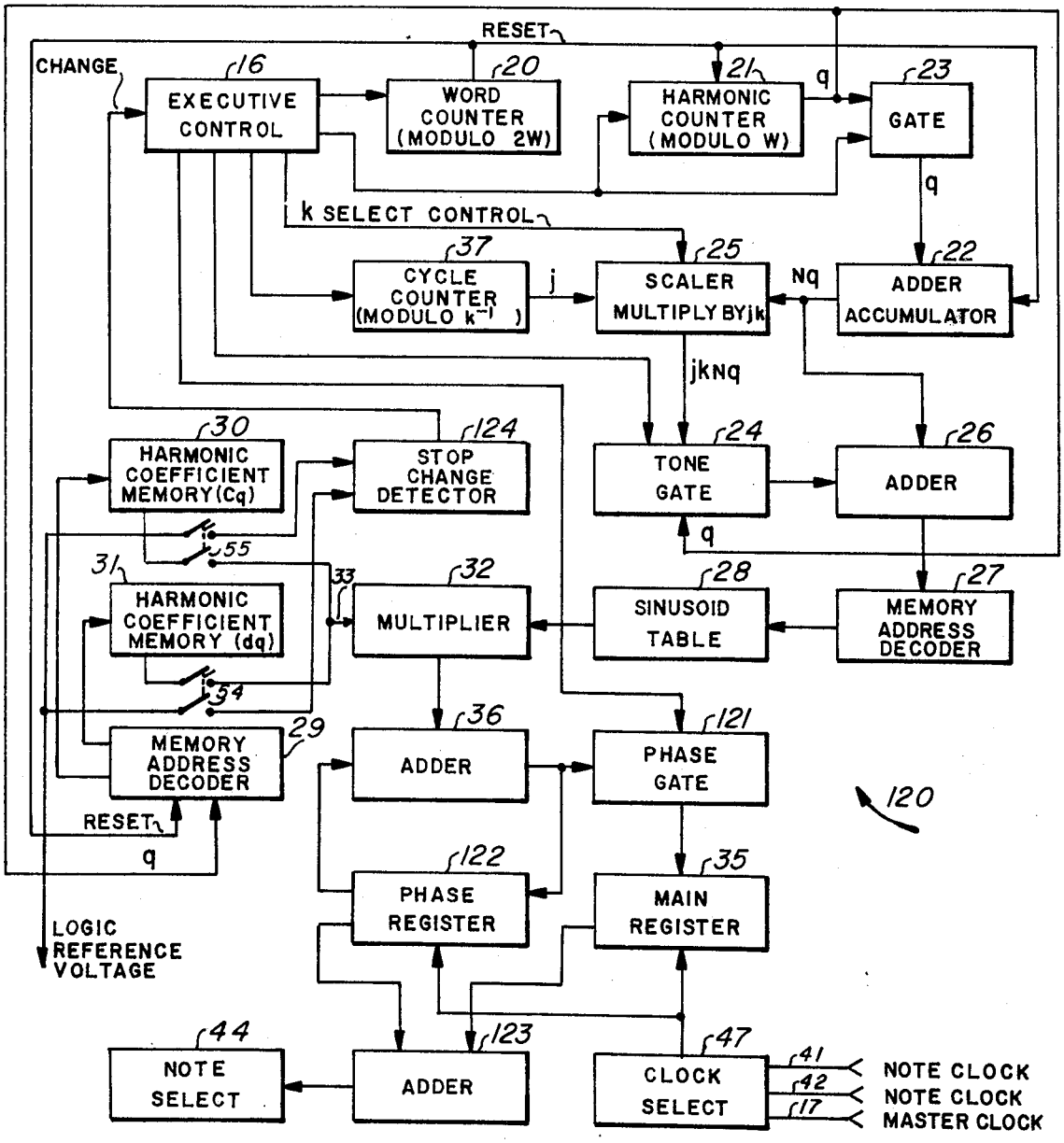
FIG. 7 is an alternative ensemble production means using a master and a phased data set.

The state of stop switches 54 and 55 are examined by stop change detector 124 by using signals transmitted by a state change contact on each stop switch which is shown in FIG. 7 as consisting of a double-pole switch. One pole is used to transmit harmonic coefficients while the second pole is used to transmit the switch state.

Figure 8:
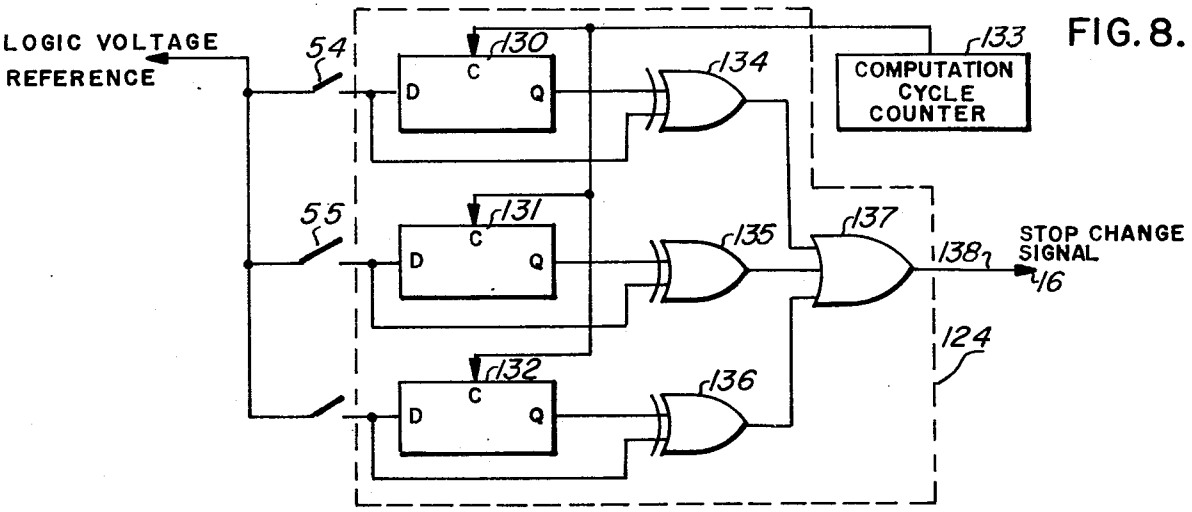
FIG. 8 is a logic diagram of an implementation for detecting a stop switch change of state.

A means for implementing stop change detector 124 is shown in FIG. 8. Stop switches 54 and 55 are represented only for the poles that transmit switch state information. A third stop switch is shown and the extension to any multiplicity of switches is immediately obvious. At the start of a normal computation cycle, the computation cycle counter 133 which counts the bit times in a computation cycle, generates a "clear" signal which resets the switch state flip-flops 130, 131, and 132. The closure of any stop switch causes its associated flip-flop to be placed in the set mode. The next time the clear signal is received, any switch that has changed state will cause a signal to be created at the output of its associated EX-OR GATE because its prior state was stored in the state of its associate flip-flop. The signals created by EX-OR GATES 134, 135, 136 are combined in OR GATE 137 to create a stop change signal. The stop change signal will be a "one" if any of the stop switches has changed its state since the last time a clear signal was transmitted. Computation cycle counter 133 is a component of executive control 16. The stop change signal is transmitted to executive control 16 which uses this signal to initiate a normal computation cycle. If the stop change signal is a "zero," signifying that no stop switches have changed state since the preceding computation cycle, executive control causes a phase computation cycle to be initiated.

A normal computation cycle requires $NW=64\times 32=2048$ bit times for the master subcomputation cycle and $NM=64M$ bit times for the phase subcomputation cycle. M is the number of harmonics used for the ensemble effect. For $M=8$, the phase subcomputation cycle requires $64\times 8=512$ bit times. Each succeeding phase computation cycle requires 512 bit times. This is a reduction of 2048 bit times compared to a normal computation cycle.

Anharmonic tone generation can also be created with system 120 shown in FIG. 7. Anharmonic tone generation is accomplished by means of tone gate 24 and $k$ select control in a manner analogous to that previously described for system 10 shown in FIG. 1.

Figure 9:
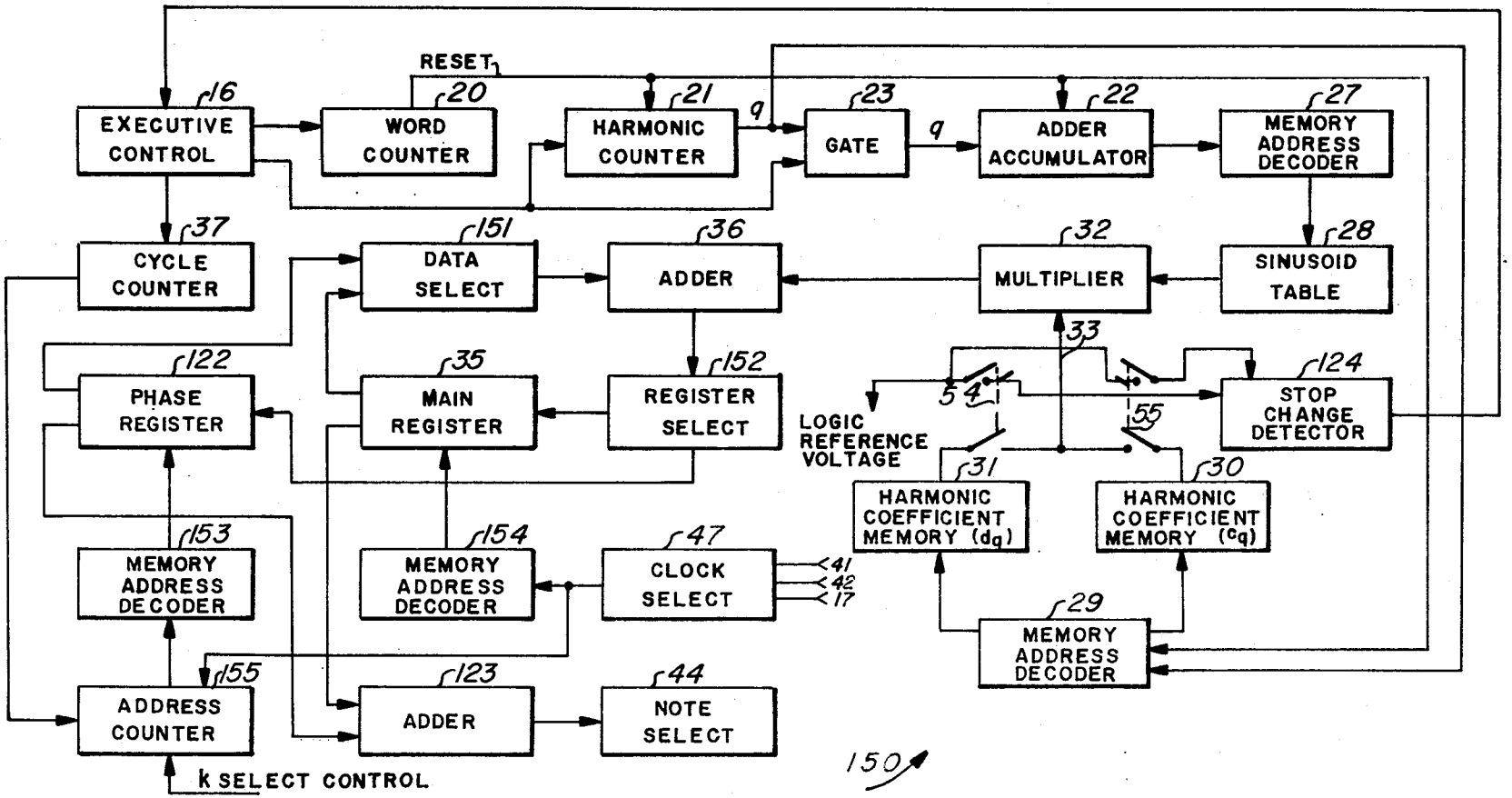
FIG. 9 is an alternative ensemble production means for reducing the average number of computations.

System 150 shown in FIG. 9 is an alternative modified means for generating an ensemble effect. System 150, unlike the prior modifications to system 10, does not create master data sets with time varying phase shifts but instead creates the required time varying phase shifts by the manner in which data is addressed from a phase data set, existing in phase register 122, during a data transfer cycle.

System 150 incorporates a normal computation cycle in which during the first portion a master data set is created in main register 35 using the harmonic coefficient set $c_q$ in a manner analogous to that previously described for system 10. During the first portion of the computation cycle, data select 151 transmits data read from main register 35 to adder 36 to be summed with the current output from multiplier 32. Register select 152 directs the summed data to be written into main register 35. Word counter 20 is caused to be a counter modulo 2W for creating the master data set in main register 35, where W is the number of harmonics.

For the second portion of the computation cycle, word counter 20 is caused to be counter modulo 2WQ, where Q is the phase resolution constant. The minimum phase shift in system 150 is 360/(2WQ)°. Advantageously, Q=4, W=32 and the phase resolution, or minimum phase shift, is 1.40625°. Data select 151 now transmits data read from phase register 122 to adder 36 to be summed with the current output from multiplier 32. Register select 152 directs the summed data to be written into phase register 122.

During a data transfer cycle, sometimes also called a load cycle, the data residing in main register 35 is read out by memory address decoder 154 and the data residing in phase register 122 is read out by memory address decoder 153. The data read from these registers are summed in adder 123 and the sum is transmitted to note select 44. There are $N=64$ data words in main register 35 and these are read out sequentially during a data transfer cycle at a selected note clock rate, closen by clock select 47, under address direction of memory address decoder 154.

Memory address decoder 153 causes data to be read from phase register at every Q'th data point (Q=4). However, the initial address of phase register 122 is selected by address counter 155. Address counter 155 is incremented by executive control 16 at the start of each data transfer cycle. Because the initial address is changed for each read out, a time increasing phase shift is created. The phase increment is controlled by signals received by address counter 155 via the $k$ select control line. These signals cause the address counter 155 to increment by one unit, two units, four units, or any desired number of units so that the corresponding phase shift increments change by corresponding amounts. The initial address is called the phase start number $h$.

FIG. 2 illustrates the principle of incremental addressing phase register 122. FIG. 2a represents the phase data set residing in phase register 122. At the first data transfer cycle, data points 4, 8, 12, 16, . . . , 256 are read out by memory address decoder 153. If the $k$ select control is chosen as one address unit, then on the second data transfer cycle $j=1$ and the addressed data points are 5, 9, 13, 17, . . . , 254, 1. The last data point would be that labelled 257, but memory address decoder contains a modulo 256 counter so that end-around addressing is accomplished. The third data transfer cycle has $j=2$ so that the addressed data points are 6, 10, 12, 18, . . . , 255, 2. This process is iterated for successive data transfer cycles. Since cycle counter 37 is modulo 256 (number of data points in phase register 122), a complete phase shift of 360 ° occurs for every 256 data transfer cycles.

System 150 does not continuously initiate new and successive computation cycles. Stop change detector 24 is used to detect a change in the state of stop switches 54 and 55. After the first computation cycle, no new such cycle is initiated unless a stop switch state change has been detected. This detection is timed for the completion of each set of data transfer cycles. In this fashion the computation cycle for system 150 is reduced to an almost zero average number of bit times, since no such computation cycle is required until the musician changes the stop switch states.

In a manner analogous to that previously described in relation to System 10 of FIG. 1, the phased master data set of System 150 of FIG. 2 may consist of a combination of R tones. The R tones are computed by the following discrete series which are counterparts of Equations 7, 8, and 9:

$$X_1(H) = \sum_{q=1}^{M_1} d_{1q} \sin(\pi Hq/WQ) \quad \text{(Equation 20)}$$

$$X_2(H) = \sum_{q=1}^{M_2} d_{2q} \sin(\pi Hq/WQ) \quad \text{(Equation 21)}$$

$$X_p(H) = \sum_{q=1}^{M_p} d_{pq} \sin(\pi Hq/WQ) \quad \text{(Equation 22)}$$

where $H=1,2,\ldots,QN$; $p=1,2,\ldots,$R is an index designating the components in the phased master data set; $M_p$ is an integer which designates the number of harmonic components in each of the component number sets $X_p$(H); $d_{pq}$ is the harmonic coefficient of the corresponding $q$th harmonic establishing the relative amplitude of the corresponding $q$th components; and Q is the phase resolution constant. Advantageously the phase constant is selected as $Q=4$. Therefore, for the illustrative example in which $Q=4$, the index H for the phased master data set assumes the sequence of values 1,2,3, . . . ,256.

It is apparent that in all the equation formulations the sine terms can all be replaced by cosine terms. Since these functions differ only by a phase shift, no audible difference is created by such a change. If such a change is implemented then all the functions stored in the sinusoid tables become cosine functions rather than sine functions.

U.S. Pat. No. 4,085,644 discloses versions of the basic system that used generalized harmonic functions in place of the previously described sinusoid functions and generalized harmonic coefficients in place of the previously described harmonic coefficients. The present invention is equally applicable for such systems in which generalized harmonic functions in combination with generalized harmonic coefficients are used to create master and phased data sets. In particular the subject invention includes the use of a table of Walsh functions to replace the sinusoid table and Walsh coefficient memories to replace the harmonic coefficient memories.

An obvious extension to system 10 as shown in FIG. 1 and previously described is to use a memory storing a set of phase constants $k_p$. The elements of this set can be selected for each member of the out-of-tune submaster data sets implemented to produce an ensemble effect. Each constant $k_p$ corresponds to a predetermined amount of frequency detuning for its associated submaster data set. When more than one submaster data set is desired as a component of the master data set, the master subcomputation cycle is followed by a multiplicity of phase subcomputation cycles for each such submaster data set that is implemented. The memory storing the phase constants $k_p$ is effectively a frequency offset memory. This set of constants can also be utilized to provide differing anharmonic overtone effects for each generated tone.

An elaborate ensemble effect can be implemented by means of a memory storing a set of phase constants $k_p$ in combination with note detect and assignor 14 shown in FIG. 1. The note detect and assignor can be used to address a predetermined value of $k_p$ for each note on the musical instrument's keyboard thereby affording a flexibility of ensemble out-of-tuning for each note.

While the subject invention was described in combination with U.S. Pat. No. 4,085,644, it is not thereby intended to be limited to such a system.

Intending to claim all novel, useful and unobvious features shown or described, the applicant claims:

1. A musical instrument exhibiting an ensemble effect comprising;

a first memory means for writing master data set to be thereafter read out, wherein number N designates the address of words in said first memory means, means to set contents of first memory means to zero values at start of a computation cycle, first means for computing number Y(N) in master data set during each computation cycle of a sequence of computation cycles for providing an emsemble effect, wherein said master data set is composed of a multiplicity R+1 of submaster data sets each containing numbers Z(N), $X_1$(N), $X_2$(N), . . . , $X_R$(N) and such computing is in accordance with the relations $$Y(N) = Z(N) + X_1(N) + X_2(N) + \ldots + X_R(N)$$

$$Z(N) = \sum_{q=1}^{W} c_q \sin(\pi Nq/W)$$

$$X_1(N) = \sum_{g=1}^{M_1} d_{1q} \sin[\pi Nq(1+jk_1)/W]$$

$$X_p(N) = \sum_{g=1}^{M_p} d_{pq} \sin[\pi Nq(1+jk_p)/W]$$

where $q=1,2,\ldots,W$; $N=1,2,\ldots,2W$; W is the number of harmonic components defining said number Z(N) and $c_q$ is the harmonic coefficient of the corresponding $q$th harmonic establishing the relative amplitude of the corresponding $q$th component of Z(N); $p=1,2,\ldots,R$ is an index designating the out-of-tune submaster data sets; $M_p$ is an integer not greater than W which specifies the number of harmonic components defining said numbers $X_p$(N) and $d_{pq}$ is the harmonic coefficient of the corresponding $q$th harmonic establishing the relative amplitude of the corresponding $q$th components; the numbers $k_p$ are phase constants selected from a set of phase constants; $j$ is a number incremented repetitively; said first means comprising a memory storing said harmonic coefficient sets $c_q$ and $d_{pq}$, a sinusoid table comprising a memory storing values of $\sin(\pi\phi/W)$ for $0 \leqq \phi \leqq 2W$ at intervals of D where D is a resolution constant, harmonic component evaluation circuitry utilizing said memory and said sinusoid table to calculate $c_q \sin(\pi Nq/W)$ for each of the W harmonic components of said number Z(N) in accordance with a selected value of N and to calculate $d_{pq} \sin[\pi Nq(1+jkp)/W]$ for each of the $M_p$ harmonic components of said numbers $X_p(N)$ in accordance with a selected value of N, means for successively algebraically summing output of said harmonic evaluation circuitry with contents of word N in said first memory means, second memory means for storing a master data set to be thereafter read out, second means responsive to first means for transferring said master data set from first memory means to said second memory means, means for converting a master data set to a musical waveshape, and third means responsive to said second means for repetitively reading out the words of said master data set from second memory means and providing said read out words to said means for converting, the musical waveshape so produced exhibiting an ensemble effect.

2. A musical instrument according to claim 1 wherein said harmonic component evaluation circuitry comprises;

a word counter incremented at each computation time in said computation cycle wherein said word counter is modulo 2W, the contents of said word counter thereby represents said number N, modulo 2W reset circuitry whereby a reset signal is created when said word counter is reset when content N equals 2W, a harmonic counter incremented by said reset signal and containing said harmonic number $q$, and an adder-accumulator for adding successive values of content $q$ of said harmonic counter wherein said adder-accumulator is cleared to zero by said reset signal, the contents of said adder-accumulator thereby representing number $Nq$.

3. A musical instrument according to claim 2 wherein said computation cycle comprises;

a multiplicity R+1 of subcomputation cycles wherein during each subcomputation cycle said numbers Z(N) and $X_p(N)$ are evaluated according to said relations and furnished to said means for successively algebraically summing.

4. A musical instrument according to claim 3 wherein said harmonic counter further comprises modulo select circuitry whereby said harmonic counter is caused to count said reset signals modulo said number W during said subcomputation cycle during which said numbers Z(N) are evaluated and whereby said harmonic counter is caused to count said reset signals modulo said number $M_p$ during subcomputation cycle during which said corresponding numbers $X_p(N)$ are evaluated.

5. A musical instrument according to claim 4 wherein said harmonic component evaluation circuitry further comprises;

a cycle counter which is incremented at the start of each said computation cycle wherein cycle counter is modulo $1/k_p$ where $k_p$ is the smallest of said set of phase constants, the contents of cycle counter thereby represents said number $j$, a first adder for summing the output resultant product $jk_pNq$ from said scaler with number $Nq$ contained in said adder-accumulator thereby evaluating arguments $Nq(1+jk_p)$, a tone gate whereby for subcomputation cycle during which said numbers Z(N) are evaluated in accordance with said relation, the number in said scaler is inhibited as an input to said first adder; thereby said first adder evaluates argument, a first memory address decoder for addressing said sinusoid table in response to said arguments created by summing in said first adder, to access from sinusoid table a corresponding stored value $\sin[\pi Nq(1+jk_p)/W]$ for said subcomputation cycles during which said tone gate is not inhibited and to access from said sinusoid table a corresponding stored value $\sin(\pi Nq/W)$ for said subcomputation cycle during which tone gate is inhibited, and a multiplier means for multiplying each such addressed term from said sinusoid table by said harmonic coefficient $c_q$ for the corresponding $q$th harmonic component during said subcomputation cycle during which said tone gate is inhibited and for multiplying each such addressed term from said sinusoid table by said harmonic coefficients $d_{pq}$ during said subcomputation cycles during which tone gate is not inhibited, the products of such multiplication being supplied to said means for successively algebraically summing.

6. A musical instrument according to claim 5 wherein said means for successively algebraically summing comprises;

first memory addressing means responsive to number N in said word counter whereby contents addressed in said first memory means are read out, and an adder for algebraically summing said products supplied from said multiplier means and contents read out from said first memory means, the summed values being stored in said first memory means.

7. A musical instrument according to claim 5 wherein said scaler comprises;

a first scaler circuitry comprising a multiplicity of binary shift registers each of which accepts said number $Nq$ in binary and right shifts $Nq$ by $m$ binary positions to perform division $Nq/2^m$, wherein a different integer $m$ is used by each member of said multiplicity of shift registers, and a multiplicity of adders summing all said divisions, a scaler division select means whereby contents of said cycle counter are caused to inhibit members of said multiplicity of binary shift registers thereby causing output of said multiplicity of adders to create number $jNq$, and a phase constant select circuitry whereby said number $j$ is multiplied by an element number $k_p$ selected from said set of phase constants.

8. A musical instrument according to claim 7 wherein said phase constant select circuitry comprises;

a binary shift register which accepts said value of $j$ in binary and right shifts said value by $u$ binary positions to obtain value $j/2^u$ wherein such divisors $1/2^u$ correspond to members of said set of phase constants, and phase select means whereby circuitry is provided for selecting said numbers $u$ of binary shift positions.

9. A musical instrument according to claim 7 wherein said phase constant select circuitry comprises a frequency offset memory storing different values of $k_p$ associated with different notes, and said third means also causing the value of $k_p$ associated with each selected note to be accessed from said frequency offset memory and supplied to said phase constant select circuitry.

10. A musical instrument according to claim 5 wherein said tone gate further comprises a fundamental inhibit circuitry responsive to said harmonic number $q$ contained in said harmonic counter whereby during said computation cycles tone gate is caused to be inhibited for values of $q$ equal to one, thereby causing said musical instrument to create musical tones having anharmonic overtones.

11. A musical instrument according to claim 10 wherein said scaler further comprises;

an overtone offset memory storing different values of said phase constants $k_p$ associated with different values of said harmonic number $q$, an overtone addressing means whereby values of phase constants $k_p$ are caused to be read out of said overtone offset memory in response to values of said harmonic number q contained in said harmonic counter, scaler multiplication means whereby said number N$q$ contained in said adder-accumulator are multiplied by said number $k_p$ read from said overtone offset memory and whereby resultant product $k_p$N$q$ is multiplied by said number $j$.

12. A musical instrument according to claim 2 wherein said harmonic component evaluation circuitry further comprises;

a cycle counter which is incremented at the start of each said computation cycle wherein cycle counter is modulo $1/k_p$, where $k_p$ is the smallest of said set of phase constants, the contents of cycle counter thereby represents said number $j$, a scaler whereby said number N$q$ contained in said adder-accumulator is multiplied by a number $k_p$ selected from said set of phase constants and whereby product $k_p$N$q$ is multiplied by said number $j$, a first adder for summing the output resultant product $jk_p$N$q$ from said scaler with number N$q$ contained in said adder-accumulator thereby evaluating arguments N$q(1+jk_p)$, a first memory addressing decoder for addressing said sinusoid table in response to argument Nq contained in said adder-accumulator, to access from said sinusoid table the corresponding stored value $\sin(\pi Nq/W)$, a second sinusoid table comprising a memory storing values of $\sin(\pi\phi/W)$ for $0 \leqq \phi \leqq 2W$ at intervals of D where D is a resolution constant, a second memory addressing decoder for addressing said second sinusoid table in response to arguments created by summing in said first adder, to access from said second sinusoid table the corresponding value $\sin[\pi Nq(1+jkp)/W]$ a second adder for summing the values $\sin(\pi Nq/W)$ addressed from said first sinusoid table with the values $\sin]\pi Nq(1+jk_p)/W]$ addressed from said second sinusoid table, and a multiplier means for multiplying the sum terms from said second adder by the harmonic coefficient $c_q$ for the corresponding $q^{th}$ harmonic during said subcomputation cycle during which numbers Z(N) are computed and for multiplying said sum terms by the harmonic coefficients $d_{pq}$ during said subcomputation cycles during which numbers $X_p(N)$ are computed, the products of such multiplication being supplied to said means for successively algebraically summing thereby causing said musical instrument to create a doubled musical effect.

13. A musical instrument according to claim 12 wherein said harmonic component evaluation circuitry further comprises;

a tone gate and control circuitry whereby said tone gate is caused to inhibit said resultant product $jk_p$N$q$ from said first adder when said harmonic number $q$ equals one, thereby causing said musical instrument to create combination of tones with anharmonic overtones and a doubled musical effect.

14. A musical instrument according to claim 2 wherein said harmonic component evaluation circuitry comprises;

a cycle counter which is incremented at the start of each said computation cycle wherein cycle counter is modulo $1/k_p$, where $k_p$ is the smallest of said set of phase constants, the contents of cycle counter thereby represents said number $j$, a multiplicity of scalers, equal to said number R, whereby each such scaler receives said number Nq contained in said adder-accumulator and multiplies N$q$ by a number $k_p$ selected from said set of phase constants and whereby each such resultant product $k_p$N$q$ is multiplied by said number $j$, a multiplicity of scaler adders, equal to said number R, each such scaler adder associated with a corresponding member of said multiplicity of scalers and whereby each scaler adder sums the result product $jk_p$N$q$from its associated scaler with number Nq contained in said adder-accumulator thereby evaluating corresponding multiplicity of arguments N$q(1+jk_p)$, a first memory addressing decoder for addressing said sinusoid table in response to argument Nq contained in said adder-accumulator to access from said sinusoid table the corresponding stored value $\sin(\pi Nq/W)$, a multiplicity R of auxiliary sinusoid tables each member of which comprises a memory storing values of $\sin(\pi\phi/W)$ for $0 \leqq \phi \leqq 2W$ at intervals of D where D is a resolution constant, a multiplicity R of auxiliary memory addressing decoders each member of which is associated with a corresponding member of said multiplicity of scaler adders whereby each auxiliary memory address decoder addresses a corresponding member of said multiplicity of auxiliary sinusoid tables to access the values $\sin[\pi Nq(1+jk_p)/W]$ associated with said arguments N$q(1+jk_p)$, a multiplicity R of multiplier means each member of which is associated with a corresponding member of said multiplicity of sinusoid tables whereby each multiplier means multiplies said accessed values $\sin[\pi Nq(1+jk_p)/W]$ by a harmonic coefficient $d_{pq}$ for the corresponding $q^{th}$ harmonic associated with each said multiplier, a multiplicity of multiplier adders whereby the product values from said multiplicity of multipliers are summed, a multiplier means for multiplying said value $\sin(\pi Nq/W)$ addressed from said sinusoid table by the harmonic coefficient $c_q$ for the corresponding $q^{th}$ harmonic, and a third adder whereby output of said multiplier means is added to output from said multiplicity of multiplier adders and whereby the added value is supplied to said means for successively algebraically summing.

15. A musical instrument according to claim 5 further comprising stop change detector means whereby a change signal is generated when state of tone switches is altered.

16. A musical instrument according to claim 15 wherein said means for successively algebraically summing comprises;

a second memory means for writing phased master data set to be thereafter read out, wherein said number N designates the address of words in second memory means, means to set contents of said second memory means to zero value at start of selected subcomputation cycle, a first and second memory addressing means responsive to number N in said word counter whereby during said computation cycle contents addressed in said first and second memories means are read out, a data gate whereby during first portion of computation cycle causes input data to be written in said first memory means and whereby during second portion of computation cycle causes said input data to be inhibited, an adder for algebraically summing said products supplied from said multiplier means and contents read out from said second memory means, the summed values being stored in said second memory means and said summed values are further furnished as said input data to said data gate, computation cycle control circuitry whereby said numbers $Z(N), X_1(N), \ldots, X_R(N)$ are caused to be computed during computation cycle when said change signal is generated and whereby said numbers $X_1(N), S_2(N), \ldots, X^R(N)$ are computed when change signal is not generated, and said second means responsive to first means for transferring further comprising an adder which sums data read out from said first memory means by said first memory address decoder with data read out from said second memory means by said second memory addressing means.

17. A musical instrument exhibiting an ensemble effect comprising;

a first memory means for writing master data set to be thereafter read out, wherein number N designates the address of words in said first memory means, means to set whereby contents of said first memory means are initialized to zero values at start of master subcomputation cycle, a second memory means for writing phased master data set to be thereafter read out, wherein contents are initialized to zero values at start of phase subcomputation cycle by said means to set, and wherein number H designates the address of words in said second memory means, first means for computing numbers Z(N) in said master data set in accordance with the relation $$Z(N) = \sum_{q=1}^{W} c_q \sin(\pi Nq/W)$$

where $q=1,2,\ldots,W$; $N=1,2,\ldots,2W$; W is the number of harmonic components defining said number Z(N) in master data set and $c_q$ is the harmonic coefficient of the corresponding qth harmonic establishing the relative amplitude of the corresponding qth component of Z(N); and whereby numbers V(H) in said phased master data set are computed in accordance with the relations $$V(H) = X_1(H) + X_2(H) + \ldots + X_R(H)$$

$$X_1(H) = \sum_{q=1}^{M_1} d_{1q} \sin(\pi Hq/WQ)$$

$$X_p(H) = \sum_{q=1}^{M_p} d_{pq} \sin(\pi Hq/WQ)$$

where $H=1,2,\ldots,QN$; $p=1,2,\ldots,R$ is an index designating the component numbers in phased master data set; $M_p$ is an integer which specifies the number of harmonic components defining said numbers $X_p(H)$; $d_{pq}$ is the harmonic coefficient of the corresponding qth harmonic establishing the relative amplitude of the corresponding qth components; and Q is a phase resolution constant; said first means comprising a memory storing said harmonic coefficient sets $c_q$ and $d_{pq}$, a sinusoid table comprising a memory storing values of $\sin(\pi\phi/W)$ for $0 \leqq \phi \leqq 2W$ at intervals of D where D is a resolution constant, harmonic component evaluation circuitry utilizing said memory and said sinusoid table to calculate $c_q \sin(\pi Nq/W)$ for each of the W harmonic components of said number Z(N) in accordance with a selected value of N and to calculate $d_{pq} \sin(\pi Hq/WQ)$ for each of the $M_p$ harmonic components of said numbers $X_p(H)$ in accordance with selected values of H and said resolution constant Q, means for successively algebraically summing output of said evaluation circuitry with contents of word N in said first memory means during said master subcomputation cycle and for successively algebraically summing output of said evaluation circuitry with contents of word H in said second memory means during said phase subcomputation cycle, third memory means for storing data to be thereafter read out, second means responsive to said first means for providing an ensemble effect by adding data read out from said first memory means with data read out from said second memory means and for transferring summed data to said third memory means, and means for converting said summed data to a musical waveshape, and third means responsive to said second means for repetitively reading out said summed data from said third memory means and providing said read out data to said means for converting, the musical waveshape so produced exhibiting an ensemble effect.

18. A musical instrument according to claim 17 wherein said harmonic component evaluation circuitry comprises;

a word counter incremented at each computation time in said master subcomputation cycle wherein said word counter counts modulo 2W, the contents of word counter thereby represents said number N and said word counter is incremented at each computation time in said phase subcomputation cycle wherein said word counter is caused to count modulo 2QW and the contents of said word counter thereby represents said number H, modulo reset circuitry whereby a reset signal is created when said word counter is reset at its maximum count, a harmonic counter incremented by said reset signal wherein said harmonic counter is caused to count said reset signals modulo said number W during said master subcomputation cycle and is caused to count said reset signals modulo said number $M_p$ during the portion of said phase subcomputation cycle wherein said numbers $X_p(H)$ are computed; thereby the contents of said harmonic counter is said harmonic number $q$, an adder-accumulator for adding successive values of said harmonic number $q$ contained in said harmonic counter wherein said adder-accumulator is initialized to zero value by said reset signal, thereby the content of said adder-accumulator is number Nq during said master subcomputation cycle and the content of said adder-accumulator is number H$q$ during said phase subcomputation cycle, a first memory address decoder for addressing said sinusoid table in response to number contained in said adder-accumulator whereby during said master subcomputation cycle the value $\sin(\pi Nq/W)$ corresponding to said number Nq contained in said adder-accumulator is accessed from said sinusoid table and whereby during said phase subcomputation cycle the value $\sin(\pi Hq/WQ)$ corresponding to said number Hq contained in said adder-accumulator is accessed from said sinusoid table, and a multiplier means for multiplying each such accessed value from said sinusoid table by said harmonic coefficient $c_q$ for the corresponding $q^{th}$ harmonic component during said master subcomputation cycle and for multiplying each such accessed value from said sinusoid table by said harmonic coefficients $d_{pq}$ during said phase subcomputation cycle, the product values created by said multiplier means are supplied to said means for successively algebraically summing.

19. A musical instrument according to claim 18 wherein said means for successively algebraically summing comprises;

a first memory addressing means responsive to contents of said word counter whereby contents addressed in said first memory means are read out during said master subcomputation cycle, a second memory addressing means responsive to contents of said word counter whereby contents addressed in said second memory means are read out during said phase subcomputation cycle, and an adder means for algebraically summing said product values supplied from said multiplier means with contents read out from said first memory means the summed values being stored in said first memory means, and for algebraically summing said product values supplied from said multiplier means with contents read out from said second memory means the summed values being stored in said second memory means.

20. A musical instrument according to claim 19 wherein said second means comprises;

a cycle counter which is incremented repetitively and is caused to count modulo number 2WQ, whereby the contents of said cycle counter is a phase constant number h, said second memory addressing means further comprising circuitry for producing phase shifted data points whereby during data transfer cycle data is caused to be accessed from said second memory means for the sequence of N word addresses $h$, $h+Q$, $h+2Q$, $h+3Q$, . . . , $h+(N-1)Q$; the elements of said sequence of word addresses being numbers modulo QN, and a data adder whereby data accessed from said second memory means in response to said second memory addressing means during said data transfer cycle is algebraically summed with data accessed from said first memory means by said first memory addressing means in response to content of said word counter and whereby said algebraically summed data is transferred to said third memory means.

21. A musical instrument according to claim 17 further comprising a stop change detector means whereby a change signal is generated when state of tone switches is altered.

22. A musical instrument according to claim 21 comprising computation control circuitry whereby in response to said change signal a computation cycle is initiated comprising said master subcomputation cycle and said phase subcomputation cycle and whereby if said change signal is not generated a computation cycle is initiated comprising said phase subcomputation cycle.

* * * * *

UNITED STATES PATENT AND TRADEMARK OFFICE

CERTIFICATE OF CORRECTION

PATENT NO. : 4,112,803

DATED : September 12, 1978

INVENTOR(S) : Ralph Deutsch

It is certified that error appears in the above-identified patent and that said Letters Patent are hereby corrected as shown below:

col. 22, line 53

$$X_1(N) = \sum_{g=1}^{M_1} d_{1q} \sin[\pi Nq(1+jk_1)/W]$$

should read $$X_1(N) = \sum_{q=1}^{M_1} d_{1q} \sin[\pi Nq(1+jk_1)/W]$$

col. 22, line 55

$$X_p(N) = \sum_{g=1}^{M_p} d_{pq} \sin[\pi Nq(1+jk_p)/W]$$

should read $$X_p(N) = \sum_{q=1}^{M_p} d_{pq} \sin[\pi Nq(1+jk_p)/W]$$

col. 26, line 1

$$\sin]\pi Nq(1+jk_p)/W]$$

should read $$\sin[\pi Nq(1+jk_p)/W]$$

UNITED STATES PATENT AND TRADEMARK OFFICE

CERTIFICATE OF CORRECTION

PATENT NO. : 4,112,803

DATED : September 12, 1978

INVENTOR(S) : Ralph Deutsch

It is certified that error appears in the above-identified patent and that said Letters Patent are hereby corrected as shown below:

col. 27, line 49

$X_1(N), S_2(N), \ldots, X^R(N)$ should read $X_1(N), S_2(N), \ldots, X_R(N)$

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*